US010112693B2

(12) United States Patent
Jukes

(10) Patent No.: US 10,112,693 B2
(45) Date of Patent: Oct. 30, 2018

(54) INTERNAL COMBUSTION ENGINE

(71) Applicant: Oxford Two Stroke Limited, Harwell Oxford, Didcot Oxfordshire (GB)

(72) Inventor: Oliver Jukes, Bristol (GB)

(73) Assignee: Joost Engines Ltd, Oxfordshire (GB)

( * ) Notice: Subject to any disclaimer, the term of this patent is extended or adjusted under 35 U.S.C. 154(b) by 0 days.

(21) Appl. No.: 15/329,203

(22) PCT Filed: Jul. 23, 2015

(86) PCT No.: PCT/GB2015/052136
§ 371 (c)(1),
(2) Date: Jan. 25, 2017

(87) PCT Pub. No.: WO2016/016617
PCT Pub. Date: Feb. 4, 2016

(65) Prior Publication Data

US 2017/0217553 A1 Aug. 3, 2017

(30) Foreign Application Priority Data

Jul. 28, 2014 (GB) ..... 1413345.8

(51) Int. Cl.
*B63H 20/14* (2006.01)
*B63H 20/12* (2006.01)
(Continued)

(52) U.S. Cl.
CPC ..... *B63H 20/12* (2013.01); *B63H 20/002* (2013.01); *B63H 20/106* (2013.01); *B63H 20/28* (2013.01);
(Continued)

(58) Field of Classification Search
CPC .... B63H 20/12; B63H 20/002; B63H 20/106; B63H 20/28; B63H 20/32; B63H 20/36; B63H 21/14; B63H 21/21
(Continued)

(56) References Cited

U.S. PATENT DOCUMENTS 1,578,228 A 3/1926 Yearsley
2,404,906 A 7/1946 Heald
(Continued)

FOREIGN PATENT DOCUMENTS

AT 511236 10/2012
FR 772815 11/1934
(Continued)

OTHER PUBLICATIONS

United Kingdom Intellectual Property Office; Combined Search & Examination Report dated Jan. 21, 2015 of Great Britain Patent Application No. 1413345.8; 5 pages.
(Continued)

*Primary Examiner* — Stephen P Avila
(74) *Attorney, Agent, or Firm* — Moore & Van Allen PLLC; Patrick B. Horne

(57) ABSTRACT

The invention provides an internal combustion engine comprising a piston mounted for reciprocating linear motion within a cylinder along a cylinder axis. The piston is coupled to an output shaft by a power transfer assembly arranged to convert linear motion of the piston to rotary motion of the output shaft. The piston has a first head moveable within a first chamber and a second head opposite the first head and moveable within a second chamber. The power transfer assembly has a lubrication system for lubricating moving components of the power transfer assembly. The lubrication system is sealed from the first chamber and the second
(Continued)

chamber to prevent the passage of fluid from the lubrication system into the first chamber and the second chamber.

43 Claims, 19 Drawing Sheets

(51) Int. Cl.

| | |
|---|---|
| ***F01B 9/02*** | (2006.01) |
| ***F02B 25/06*** | (2006.01) |
| ***F01B 7/02*** | (2006.01) |
| ***F02B 25/08*** | (2006.01) |
| ***F02B 33/06*** | (2006.01) |
| ***F02B 61/04*** | (2006.01) |
| ***F02B 75/28*** | (2006.01) |
| ***B63H 20/00*** | (2006.01) |
| ***B63H 21/21*** | (2006.01) |
| ***B63H 20/36*** | (2006.01) |
| ***B63H 20/28*** | (2006.01) |
| ***B63H 20/32*** | (2006.01) |
| ***B63H 21/14*** | (2006.01) |
| ***B63H 20/10*** | (2006.01) |

(52) U.S. Cl.
CPC ..... *B63H 20/32* (2013.01); *B63H 20/36* (2013.01); *B63H 21/14* (2013.01); *B63H 21/21* (2013.01); *F01B 7/02* (2013.01); *F01B 9/023* (2013.01); *F02B 25/06* (2013.01); *F02B 25/08* (2013.01); *F02B 33/06* (2013.01); *F02B 61/045* (2013.01); *F02B 75/28* (2013.01); *B63B 2758/00* (2013.01); *B63H 2021/216* (2013.01)

(58) Field of Classification Search
USPC ..... 114/88 L
See application file for complete search history.

(56) References Cited

U.S. PATENT DOCUMENTS

| | | | | |
|---|---|---|---|---|
| 4,850,313 | A | 7/1989 | Gibbons | |
| 6,408,832 | B1 * | 6/2002 | Christiansen ..... | F02B 29/0418 123/311 |
| 9,611,805 | B2 * | 4/2017 | Jukes ..... | F02F 3/28 |
| 2005/0009420 | A1 * | 1/2005 | Yoshida ..... | F01M 11/02 440/88 L |
| 2014/0199898 | A1 * | 7/2014 | Takase ..... | B63H 20/02 440/63 |

FOREIGN PATENT DOCUMENTS

| | | |
|---|---|---|
| GB | 1203561 | 8/1970 |
| GB | 1285899 | 8/1972 |
| GB | 1446851 | 8/1976 |
| JP | S55163401 U | 11/1980 |
| WO | WO 2008/010490 | 1/2008 |
| WO | WO 2014/001788 | 1/2014 |

OTHER PUBLICATIONS

Patent Cooperation Treaty; International Search Report dated Nov. 17, 2015 of PCT/GB2015/052136; 9 pages.
Patent Cooperation Treaty; Written Opinion of the International Searching Authority dated Nov. 17, 2015 of PCT/GB2015/052136; 7 pages.

* cited by examiner

Fig. 12g
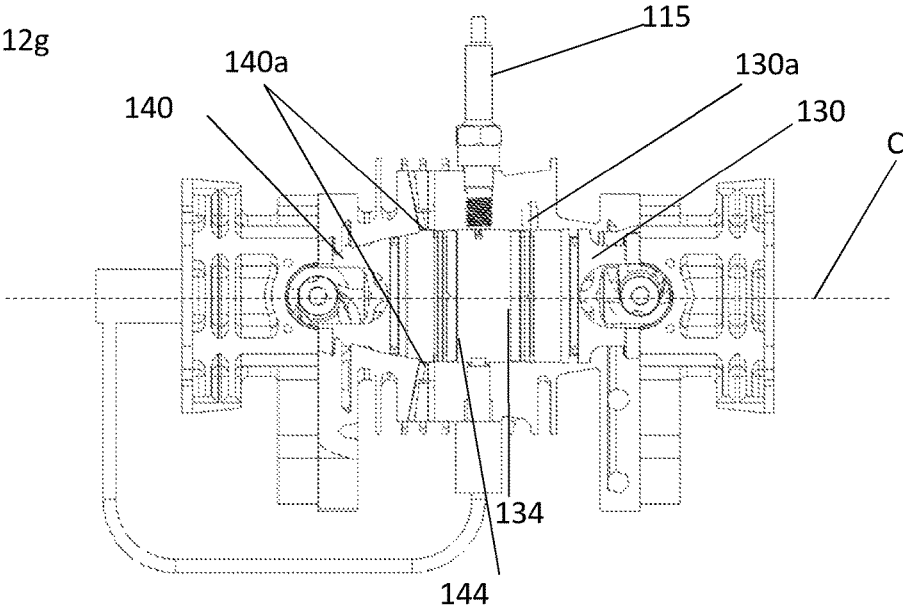
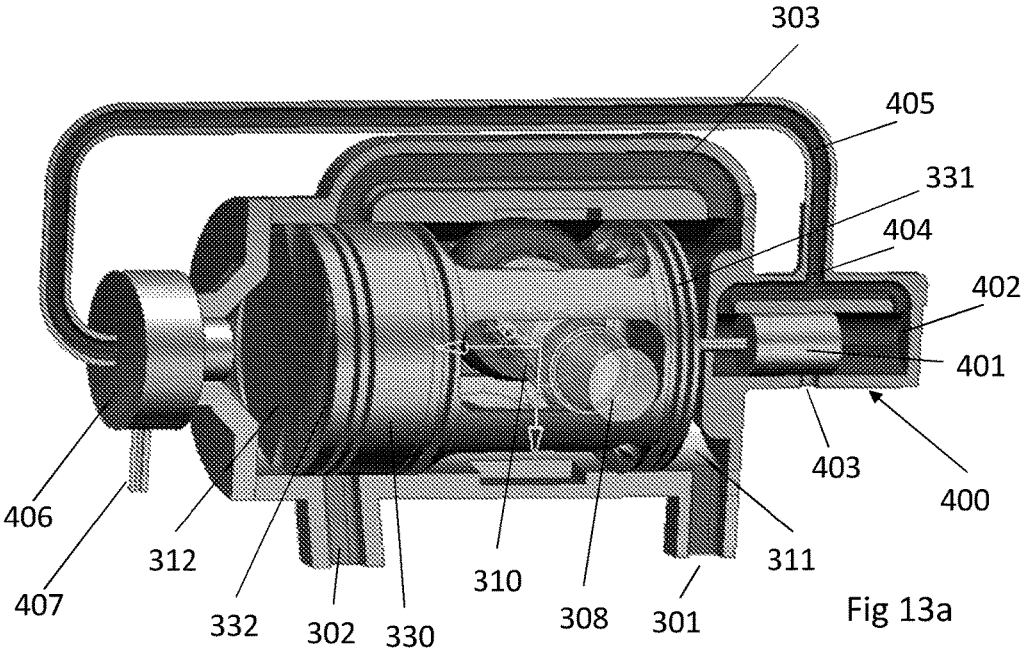
Fig 13a

INTERNAL COMBUSTION ENGINE

FIELD OF THE INVENTION

The present invention relates to an internal combustion engine, and to a propulsion unit for a water craft including the internal combustion engine.

BACKGROUND OF THE INVENTION

Conventional internal combustion engines operating on either a two-stroke or a four-stroke cycle commonly use a crankshaft and con rod arrangement to convert linear motion of a piston to rotary motion at an output shaft. Due to the crankshaft and con rod geometry, maximum piston acceleration generally occurs when the piston is at top dead centre (TDC), where piston acceleration is significantly greater than at bottom dead centre (BDC). This reduction in TDC dwell time (time spent at or near TDC) has several negative effects, including reduced efficiency and engine unbalancing.

Several alternative engine arrangements are known which use different combustion chamber to output shaft coupling mechanisms to reduce maximum piston acceleration and increase TDC dwell time. However, these are generally complex and are difficult and expensive to manufacture.

In addition to the problems mentioned above, conventional two-stroke engines also suffer from problems with lubrication of the crankshaft and con rod assembly. The crankshaft and con rod assembly is generally housed within a crank case forming part of the induction system. The lubrication system operates as a total loss system in which lubricating oil is continuously fed into the crank case and allowed to pass into the combustion cylinder and thence out of the engine. This total loss lubricating system is damaging to the environment due to the presence of lubricating oil in the exhaust gases. The use of the crank case as a supercharging or induction chamber also limits the ability of engine designers to optimise the volume and shape of the induction chamber to maximise performance and efficiency of the engine.

Conventional crankshaft and con-rod two and four stroke internal combustion engines in general favour having a long piston travel in relation to its diameter to provide greater thermodynamic efficiency and to meet ever increasingly stringent emissions criteria. The longer piston travel in turn requires a greater crank eccentricity, which when combined with the space occupied by the moving conrod produces a correspondingly large frontal area in the axis of the crankshaft.

This frontal area in the axis of the crankshaft is often increased by configurations or mechanisms to provide vibrational balance—for example offsetting multiple cylinders in a V shape or opposed piston shape or the addition of counterbalancing flywheels or shafts.

This orthodox design approach, starting with the optimization of the engine, makes it fundamentally difficult or unattractive to submerge the engine in water (in the case of an outboard motor) because of the increased drag or drag in air in the case of aircraft or bulkiness in the case of motorbikes and other forms of transport, and other applications such as generators, range extenders, garden tools, etc., where use of space is an important design consideration and requires optimization.

Outboard motors for water craft, particularly the portable end of the market requiring power outputs generally below around 20 horse power, currently employ relatively inexpensive four-stroke engines. Tighter emissions regulations have reduced the use of two stroke engines at lower powers (in fact it is now illegal to sell many two stroke outboard engines in certain countries) and favoured the development of cleaner four strokes.

SUMMARY OF THE INVENTION

A first aspect of the invention provides an internal combustion engine comprising a piston mounted for reciprocating linear motion within a cylinder along a cylinder axis, the piston is coupled to an output shaft by a power transfer assembly arranged to convert linear motion of the piston to rotary motion of the output shaft, the piston has a first head moveable within a first chamber and a second head opposite the first head and moveable within a second chamber, the power transfer assembly has a lubrication system for lubricating moving components of the power transfer assembly, wherein the lubrication system is sealed from the first chamber and the second chamber to prevent the passage of fluid from the lubrication system into the first chamber and the second chamber.

The power transfer assembly may include a linear motion bearing in positive contact with the piston. Using a linear motion bearing (rather than a conventional crankshaft and con-rod) makes it possible to minimize the frontal area of the engine. The eccentricity of the crank may be fully contained within the diameter of the piston. It also makes it possible to minimize or eliminate the requirement for vibrational balancing elements because the linear motion bearing can result in sinusoidal piston motion with respect to output shaft rotation. This sinusoidal piston motion can avoid the effect of cosine shortening in con-rod engines and so extend TDC dwell time—improving both power delivery and combustion efficiency.

A "linear motion bearing" in this context is a bearing movable along a substantially linear path with respect to the piston. The path need not be exactly linear and may include a slight curve. The path crosses the axis of linear reciprocating motion of the piston.

The power transfer assembly may include a sliding bearing or a rolling bearing. The sliding or rolling bearing may be a linear motion bearing, as described above.

The linear motion bearing may have a portion arranged to move relative to the piston along a linear axis substantially transverse to the cylinder axis.

The linear motion bearing may have a portion arranged to move relative to the piston along a linear axis substantially inclined with respect to the cylinder axis.

The linear motion bearing may be coupled to the piston via a non-planar bearing surface thereby allowing rotation of the linear motion bearing.

The power transfer assembly may be arranged such that the output shaft is between the first head and the second head of the piston.

The internal combustion engine may further comprise a first oil seal between the piston and the cylinder on one side of the power transfer assembly, and a second oil seal between the piston and the cylinder on the other side of the power transfer assembly.

The first chamber may be a combustion chamber and the second chamber may be a scavenge chamber arranged to supply inlet air to the combustion chamber. The twin headed piston has one head in the combustion cylinder ('combustion head'), with the other ('scavenge head') acting to pump air into the cylinder and so evacuate the combustion cylinder as well as provide consistent transfer pressure throughout the rev range.

A first piston-to-bore clearance between the first head and the cylinder may be greater than a second piston-to-bore clearance extending between a region adjacent the first oil seal to a region adjacent the second oil seal. For example, it may be desirable that the "hot" end of the piston (i.e. the combustion head) has a greater piston-to-bore clearance.

The internal combustion engine may further comprise a pump having a pumping volume external to the scavenge chamber, wherein the pump is driven by motion of the piston.

The pump may be arranged to supply pressurised gas to a fuel injection system having an outlet in the combustion chamber. Alternatively, the pump may be arranged to pump fuel (a liquid fuel or liquid/gaseous fuel or a pure gaseous fuel) and/or a fuel/air mixture to the fuel injection system.

The internal combustion engine may further comprise a first transfer conduit extending between the scavenge chamber and the combustion chamber, and a second transfer conduit extending between the pump and the fuel injection system.

The internal combustion engine may further comprise an anti-ventilation plate, and the first transfer conduit may be adjacent the cylinder and the anti-ventilation plate.

The second transfer conduit may be arranged to convey gas at a higher pressure than the first transfer conduit.

The fuel injection system may comprise a fuel injection port in the cylinder. The second transfer conduit may be coupled to the fuel injection port. The port may be specifically aimed towards a spark plug in the cylinder to create a locally rich mixture to enable lean running.

The injection timing may be adjusted by the position of the injection port.

The injection timing may be influenced by the size of the injection orifice, for example a restrictive orifice may delay the injection timing to minimize the emission of unburnt hydrocarbons.

The pump may include a reciprocating piston.

The pump may include a one way inlet valve and a one way outlet valve permitting a large volume ratio which in turn maximises the linearity of the quantity displaced at all engine speeds.

The pump's piston stroke may be dictated by the throw of the crankshaft and therefore its diameter may be sized to deliver a specific quantity of gaseous fuel for stoichiometric burn at wide open throttle.

In order to maintain stoichiometric ratio at all engine loads, the pump may be throttled by an independent throttle valve to reduce the volumetric efficiency of such pump in accordance with reduced volumetric efficiency of the main scavenge pump whilst throttled for lower power requirements.

The first chamber may be a first combustion chamber and the second chamber may be a second combustion chamber, the engine further comprising an external supercharger arranged to supply inlet air to the first and second combustion chambers alternately.

A first piston-to-bore clearance between the first head and the cylinder may be greater than a second piston-to-bore clearance extending between a region adjacent the first oil seal to a region adjacent the second oil seal.

A third piston-to-bore clearance between the second head and the cylinder may be greater than the second piston-to-bore clearance.

The internal combustion engine may include a plurality of the pistons.

Two or more of the pistons may be mounted for reciprocating linear motion within a common cylinder.

An adjacent pair of the pistons may be arranged in an opposed relationship and share a common combustion chamber. The opposed piston arrangement improves thermal efficiency and makes it possible to split the power delivery into two output shafts rather than the conventional one, thus further reducing the engine frontal area. The opposed piston arrangement also provides natural vibrational balance.

The scavenge heads of adjacent pistons may optionally share a common chamber and act in an opposed scavenge piston configuration to simplify and reduce the number of valves.

Each piston may be coupled to a respective power transfer assembly.

The power transfer assemblies may be arranged to operate the adjacent pair of pistons out of phase.

A plurality of the power transfer assemblies may be coupled to a common output shaft.

Each piston may be coupled to a respective output shaft by a respective one of the power transfer assemblies.

The output shaft(s) may be arranged to drive one or more drive shafts in rotation, wherein the one or more drive shafts are rotatable about drive axes substantially parallel to the cylinder axis.

Importantly, to increase power without significantly increasing frontal area, the invention may provide multiple cylinders with the pistons all in the same axis. This implies a series of crankshafts, each connecting to one singular prop shaft (though it may be possible to use multiple props also).

One drive shaft may be arranged to be driven by multiple output shafts, the engine further comprising a mechanical coupling for synchronising the rotational position of the multiple output shafts.

The internal combustion engine according may be a two cycle engine.

The internal combustion engine may be powered by a gaseous phase fuel. Preferably, but not necessarily, the invention uses LPG or other gaseous phase fuels as its energy source. This may be particularly beneficial in a two stroke engine with a retained oil crank lubrication design which can tolerate fuels which are not lubricant bearing nor does it require any form of total loss lubrication system.

A further aspect of the invention provides a propulsion unit for a water craft including the internal combustion engine according to the first aspect. The significantly improved power density of the engine as compared with conventional designs makes the propulsion unit significantly lighter by around 50 to 75%. Moreover, a significant part of this mass may be submerged meaning its weight is partially counteracted by buoyancy which further reduces loads due to gravity acting on the transom or other attachment of the propulsion unit to the water craft. For example a 6 HP outboard motor may weigh about 6 Kg versus more than 25 Kg with existing alternatives. Such weight savings have significant impact on the general usability of the outboard motor, from installation to reduced balasting effect on the boat's performance, to increased effective power experienced by the boat, to compact storage and portability.

The propulsion unit may further comprise a propeller arranged to be driven in rotation by the engine. The propeller may be in unshielded contact with the water, or may have protective shielding around it. Alternatively, the propeller may be in contact with air when used to propel a hovercraft or aerial vehicle. Alternatively, instead of a propeller, the propulsion unit may further comprise an impeller. The impeller may be open, shrouded, or partially shrouded.

The cylinder axis of the engine may be oriented substantially parallel to an axis of rotation of the propeller. Alternatively, the cylinder of the engine axis may be oriented substantially perpendicularly to an axis of rotation of the propeller or impeller.

The engine may have an exhaust outlet submerged beneath a surface of a body of water in which the watercraft is operating.

The propulsion unit may further comprise a steering "post" above the engine. The post may be a tube or other appropriately shaped casting, for example. The propulsion unit may be attached to the rear transom of a boat like an outboard engine or it may be contained within a recess along the hull of the boat or may be used at other points around the boat to provide positioning thrust rather than forward propulsion. The propulsion limit may further include a hinged joint between the steering post and the output shaft.

The steering post may include one or more of a breathing snorkel, a fuel supply line, a pull start cord, engine control electronics, ancillaries, etc.

The internal combustion engine of the propulsion unit may be adapted to operate at least partially submerged beneath a surface of a body of water in which the watercraft is operating.

The internal combustion engine of the propulsion unit may further comprise a casing arranged to provide direct cooling of the engine by the surrounding body of water. This eliminates the cost, weight and complexity of a water pump to convey cooling water, water jackets to transfer heat from the engine, flow cavities for the cooling water, long drive shaft, vibrational balancing elements and separate oil sump for lubricating the reduction drive. In addition, these make the engine easier to winterize or service prior to storage over winter because the flushing process is easier. It is possible to make one outboard that is suitable or adjustable for all boat transom sizes because there is no fixed shaft dimension.

BRIEF DESCRIPTION OF THE DRAWINGS

Embodiments of the invention will now be described with reference to the accompanying drawings, in which:

FIGS. 12*a-g* illustrate a cycle with out of phase opposed pistons;

FIG. 13*a* illustrates an air assisted fuel injection pump for use with the engine;

DETAILED DESCRIPTION OF EMBODIMENT(S)

Figure 1:
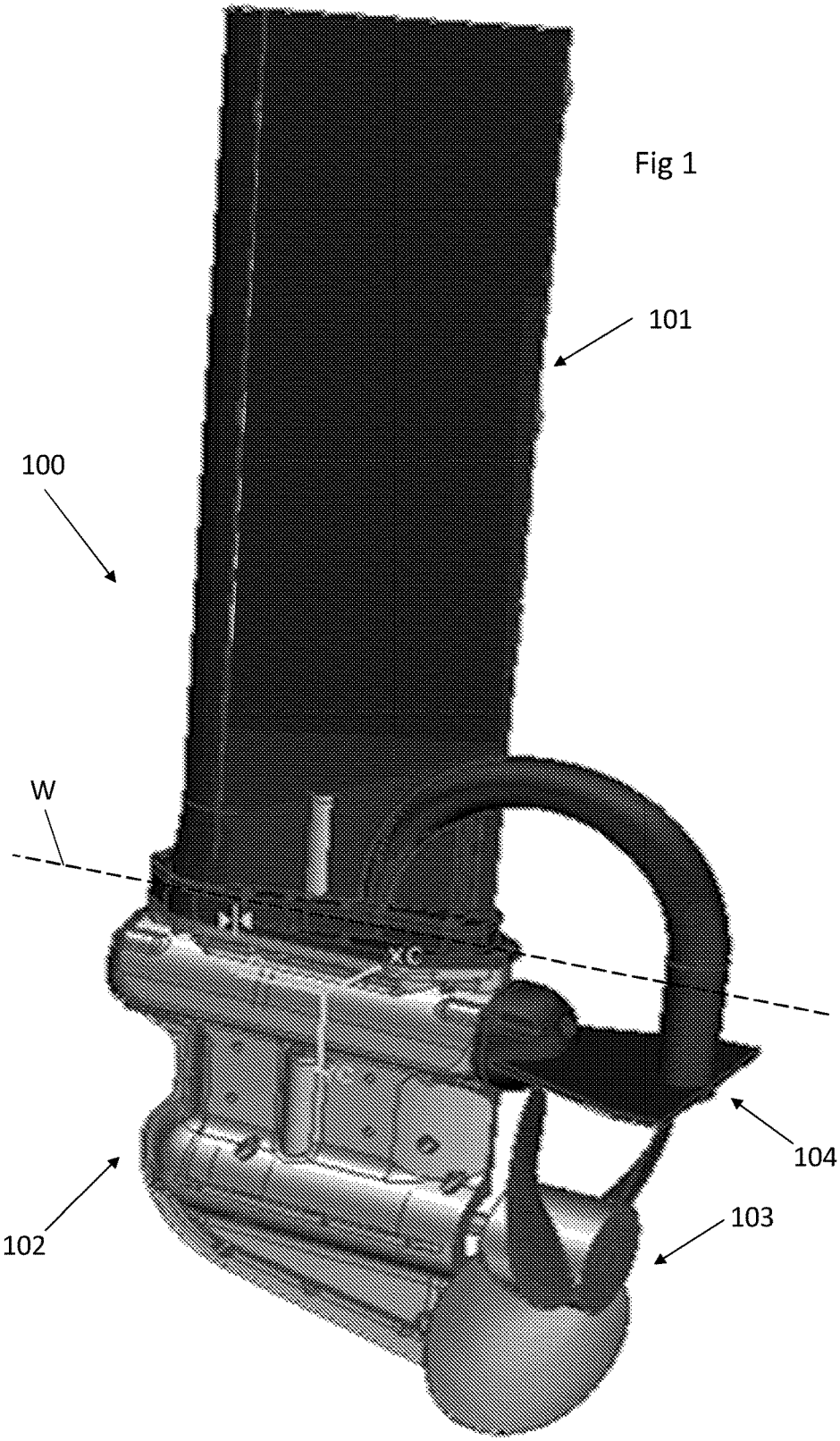
FIG. 1 illustrates an outboard motor for a water craft.

FIG. 1 illustrates an outboard motor 100 for a water craft. The outboard motor 100 includes a main body/steering post 101 above an intended water level W (when in use) and a submerged internal combustion engine and reduction drive 102 generally below the water level W. An open propeller 103 is coupled so as to be driven in rotation by the internal combustion engine and reduction drive 102. In the particular embodiment illustrated the outboard motor 100 is "portable" and is directed to the segment of the outboard motor market that require frequent removal, storage, refitting etc., of the outboard motor to the watercraft. In general, the portable outboard motor market currently demands a power output in the region of up to 20 horsepower. However, it will be appreciated that the principles of the invention may be applied to a wide variety of outboard motors in different market segments that may or may not be portable and may develop power outputs of up to several hundred horsepower. Moreover, by increasing the specific power of the engine the "portable" end of the market may be extended to much higher power ratings than is currently available.

Returning to the particularly illustrated embodiment, outboard motors developing up to around 20 horsepower are particularly suitable for water craft such as small boats and tenders. However, the invention has applicability to wide variety of watercraft. The outboard motor 100 is configured for attachment to the rear transom of the water craft.

An anti-ventilation plate 104 prevents the propeller 103 from drawing in air from above. The main body/steering post 101 accommodates a breathing snorkel for delivering a supply of ambient air to the engine, a fuel supply line for delivering a supply of gaseous or liquid fuel such as petrol, butane, liquid propane gas or diesel for example, a pull start cord, controlled electronics, ancillaries, etc. The main body/steering post 101 is configured for attachment to a steering system of the watercraft. This may be a mechanical steering linkage coupled to a steering wheel on board the water craft, for example, or maybe a simple tiller attachment for steering manually.

Figure 2:
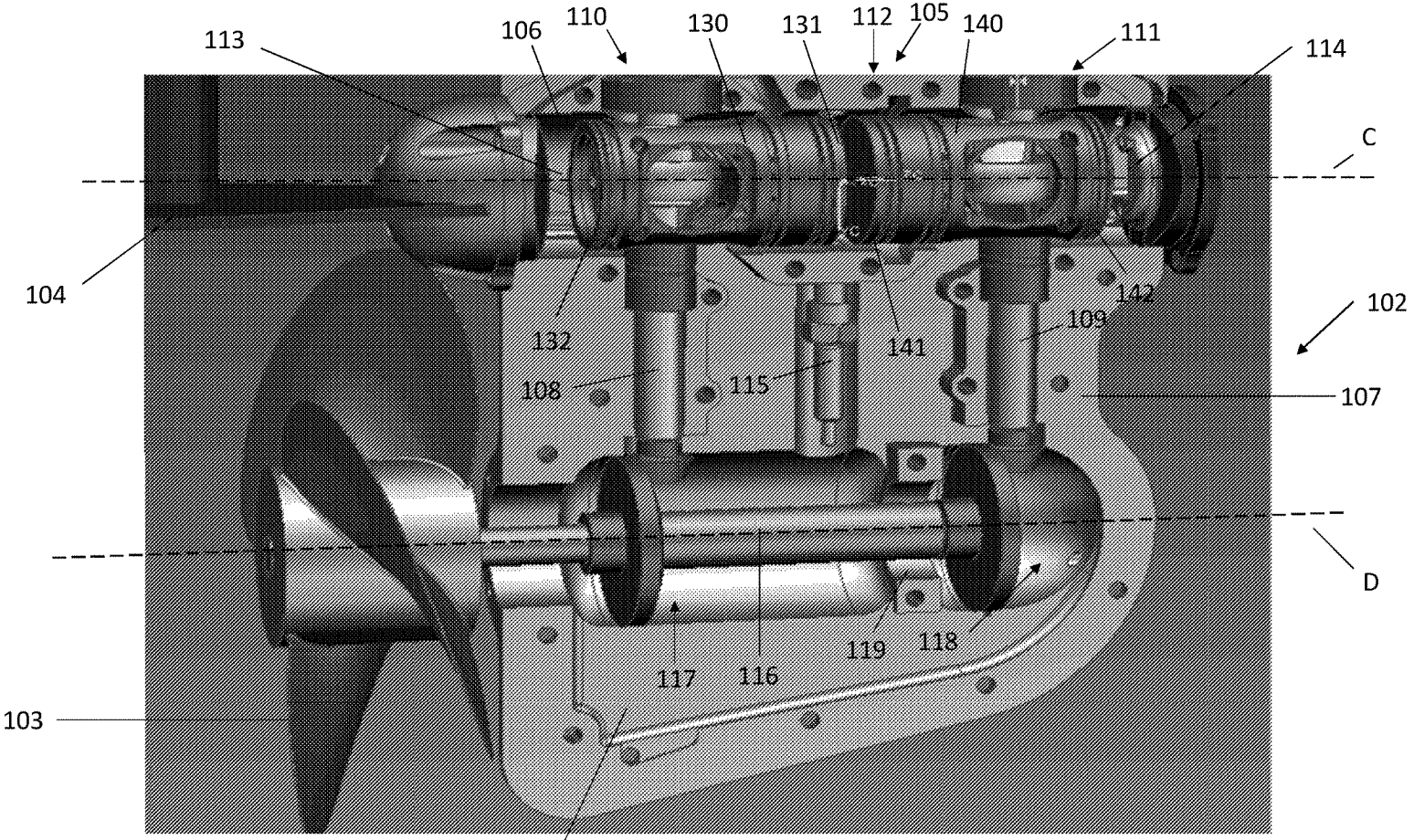
FIG. 2 illustrates a cutaway view of the internal combustion engine and reduction drive of the outboard motor in detail.

FIG. 2 illustrates a cutaway view of the internal combustion engine and reduction drive 102 in detail. The internal combustion engine 105 includes a first piston 130 and a second piston 140. The first and second pistons 130, 140 are mounted for reciprocating linear motion within a cylinder 106 formed as a cylindrical bore in engine casing 107. The engine casing 107 is formed in two halves (only one of which is visible in FIG. 2) which are bolted or otherwise fixed together. A single piece cylinder sleeve is fitted within the engine casing. The first and second pistons 130, 140 are mounted for movement along a cylinder axis positioned along the geometric centre of the cylinder 106 and extending along the length of the cylinder. Alternatively, the engine casing may be formed as a single piece (i.e. without a cylinder sleeve where instead removable crankshaft bearing carriers may be used to permit assembly and disassembly of the crankshafts and pistons).

The first piston 130 and the second piston 140 are coupled to respective output shafts 108, 109 by respective power transfer assemblies 110, 111. The power transfer assemblies 110, 111 are arranged to convert linear motion of the respective piston, 130, 140, to rotary motion of the respective output shafts 108, 109. The first piston 130, first output shaft 108 and first power transfer assembly 110 are substantially identical to the second piston 140, second output shaft 109 and second power transfer assembly 111, although the pistons are arranged in an opposed relationship as will be described in further detail below.

The first piston 130 has a first head 131 at one end of the piston and a second head 132 at an end of the piston opposite the first head. Likewise, the second piston has a first head 141 and a second head 142 opposite the first head. In this context, "opposite" means that the first head and the second head of each piston faces away from the other along the cylinder axis. The first heads 131, 141 of the pistons share a common combustion chamber 112 and are arranged to move within the shared combustion chamber. The respective second heads 132, 142 move within respective scavenge chambers 113, 114.

The combustion chamber 112 is connected to the respective scavenge chambers 113, 114 by a respective transfer port having an inlet at the scavenge chamber and an outlet at the combustion chamber. The combustion chamber also has an exhaust port connected to an exhaust duct. The scavenge chambers 113, 114 each have an intake port connected to an intake duct including a one way valve.

In the particularly illustrated embodiment shown in FIG. 2 the internal combustion engine is a spark ignition two-stroke engine and the combustion chamber 112 has an opening into which a spark plug 115 extends. The first and second output shafts 108, 109 are coupled to a coupled drive shaft 116. The propeller 113 is attached at one end of the drive shaft 116 such that rotational torque of the drive shaft 116 is imparted to the propeller 103. The output shafts 108, 109 are arranged to transmit torque to the drive shaft 116 by respective bevel gear arrangements 117, 118. In the illustrated embodiment the bevel gear arrangements 117, 118 develop a gear reduction ratio. However, it will be appreciated that any gearing ratio (greater, equal to, or less than one) may be achieved as desired. The drive shaft 116 has an axis of rotation D substantially parallel to the cylinder axis C. The output shafts 108, 109 have rotational axis substantially perpendicular to the cylinder axis C and the drive axis D. The drive shaft 116 is mounted on bearings 119 within the casing 107. The outboard motor 100 has a particularly small frontal area in the direction of travel making it ideally suited for submersion below the waterline W when in use.

This small frontal area is achieved by several design features. First, the power transfer assemblies 110, 111 are fully contained within the diameter of their respective pistons 130, 140 within respective power transfer assembly chambers. Second, the opposed piston arrangement of the engine splits the power delivery into the two output shafts 108, 109 (rather than a conventional single drive shaft), which drive two smaller bevel gears (rather than one large bevel gear). Third, the pistons 130, 140 are arranged for reciprocating movement along the same cylinder axis (rather than multiple cylinders having spaced axes). Fourth, the cylinder axis C and the drive shaft axis D are arranged so as to extend in the fore aft direction of travel.

This combination provides a particularly small frontal area, making it practical to completely submerge the internal combustion engine and reduction drive 102 beneath the waterline W. Submerging the engine and reduction drive in this way provides several advantages. The submerged unit provides direct water cooling of the internal combustion engine by heat transfer through the engine casing 107. The submerged unit also provides noise suppression from the engine and reduction drive. Furthermore, manufacturing and maintenance costs are significantly reduced as there is no requirement for a for a conventional water pump and complex cylinder castings which incorporate internal cavities for cooling water, due to the direct water cooling of the engine and reduction drive 102.

By submerging the engine and positioning the engine adjacent the drive shaft (propeller shaft) significant weight savings can be achieved as compared with a conventional outboard motor with a drive shaft running down from the above surface engine to the submerged propeller shaft. Moreover, the high power density two-stroke engine illustrated in FIG. 2 is significantly lighter than a comparable power four-stroke engine typically found in conventional outboard motor designs. This schematic weight saving makes the outboard motor 100 easy to install, remove, transport and store. Moreover, two-stroke engines produce higher torque at low revs ("hole shot") as compared with four-stroke counterparts. For outboard motors having a power output of up to around 20 to 45 horsepower, it may be possible to carry the outboard motor 100 in a backpack or similar carry bag. The lightweight outboard motor 100 can be readily transported home by car without use of trolleys or requirement for local storage at a marina, for example. The outboard motor 100 is also easier to store on board the watercraft.

Besides significant weight and size reductions for comparable power output to a conventional outboard motor, the outboard motor 100 also provides additional advantages. For example, the height of the outboard motor can be adjusted without consideration for fixing heights because of the absence of a fixed drive shaft extending from an above-surface engine to a submerged prop shaft. Furthermore, end of year servicing may be made easier and safer because there is no need to flush through and clean any water cooling manifolds, due to the direct water cooling. Further, the low frontal area of the submerged engine and reduction drive provides a significant rudder effect. As can be seen best in FIG. 1, the submerged portion of the outboard motor 100 beneath the waterline W has a streamlined shape with a particularly small frontal area and a relatively large side area. This side area provides an increased rudder effect improving the ability to steer the watercraft at lower speeds.

Figure 3:
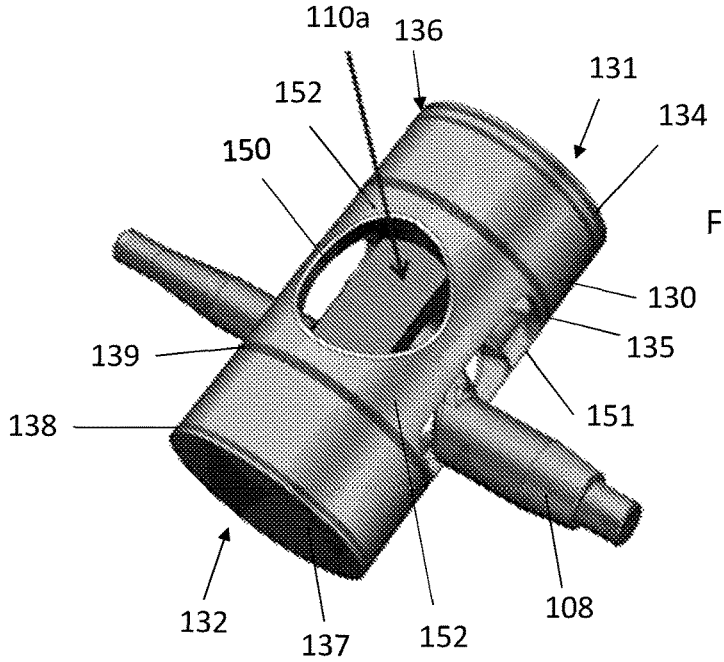
FIGS. 3 and 4 illustrate a piston of the engine with two alternative power transfer assemblies.
Figure 4:
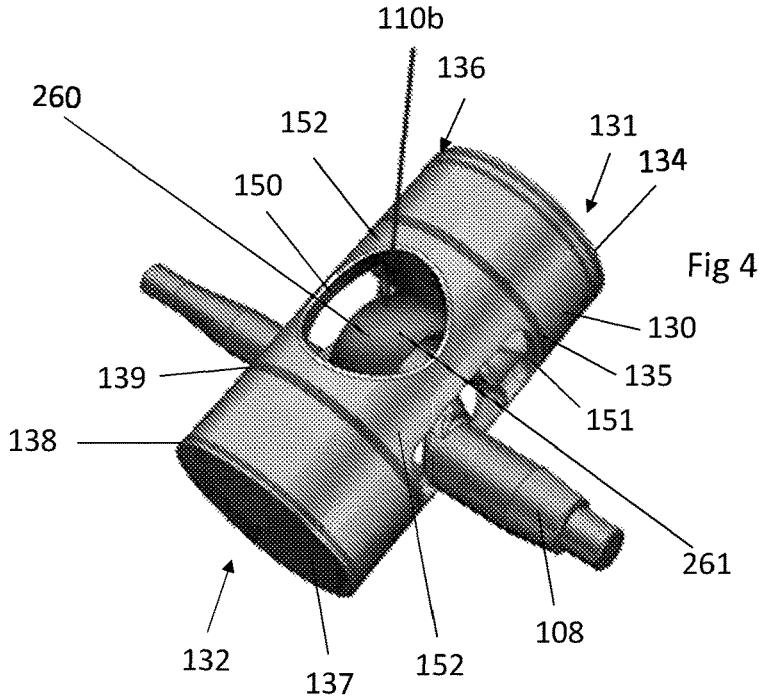
Figure 5:
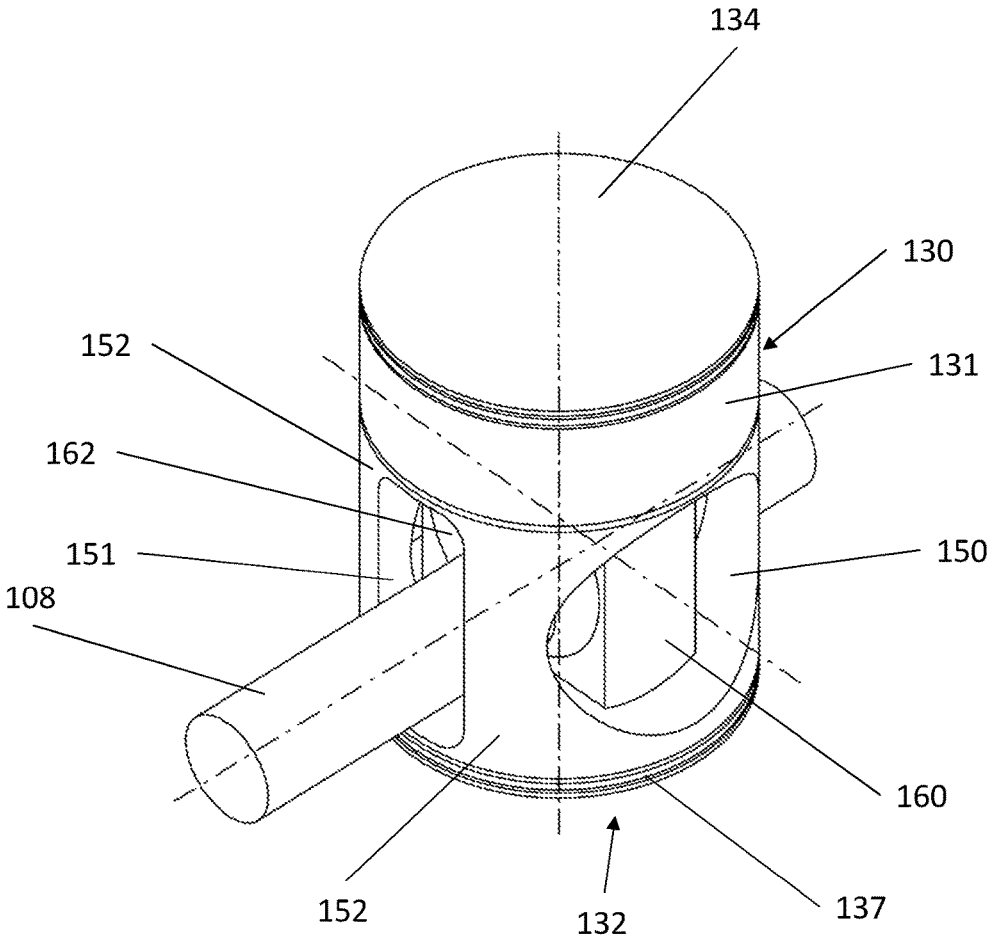
FIGS. 5 to 9 illustrate further views of the piston and power transfer assembly of FIG. 3 including a sliding linear motion bearing.

FIGS. 3 and 4 show the piston 130 with two alternative power transfer assemblies 110*a*, 100*b* (the power transfer assembly for the piston 140 being identical).

Before describing the power transfer assemblies key features of the piston 130 will be explained with reference to FIG. 3. The first head (or combustion head) 131 of the piston 130 which is moveable within the cylinder bore has a working face 134 which forms a moveable boundary of the combustion chamber 112. The combustion head 131 has an extended piston skirt extending away from the working face 134. A first oil seal 135 is mounted to the piston skirt sufficiently far from the working face 134 that it does not pass the intake and exhaust ports during reciprocating motion of the piston 130. The combustion head 131 has gas seal rings 136 fitted in grooves formed in its cylindrical outer surface which provide a gas-proof seal between the combustion head 131 and the cylinder bore.

The piston 130 also includes a second head (or scavenge head) 132 which is movable within the cylinder bore and has a working face 137 which forms a movable boundary of the scavenge chamber 113. The scavenge head 132 has gas seal rings 138 and a second oil seal ring 139 fitted in grooves formed in its cylindrical outer surface which provide a gas-proof and oil-proof seal between the scavenge head and the cylinder bore.

The piston 130 further includes a circular through bore 150 extending along an axis perpendicular to a piston axis extending in the direction of reciprocating motion of the piston, and a through slot 151 extending in a direction substantially perpendicular to the axis of the bore 150. The scavenge head 132 is connected to the combustion head 131 by four linking elements 152, which together define the bore 150 and the slot 151.

Both these power transfer assemblies 110*a*, 110*b* include a linear motion bearing in positive contact with the piston, where the linear motion bearing has a portion arranged to move relative to the piston along a linear axis substantially transverse to the cylinder axis C. In the FIG. 3 arrangement the linear motion bearing is a sliding bearing, and in the FIG. 4 arrangement the linear motion bearing is a rolling bearing.

The power transfer assembly 110*a* including the sliding bearing is shown in more detail in FIGS. 5 to 9. The sliding bearing 160 is received within the bore 150 and has first and second part-cylindrical bearing surfaces 161 which engage the bore 150 of the piston 130. The sliding bearing 160 includes a bore 163 extending through its thickness and having an axis parallel to the output shaft 108 axis.

Figure 6:
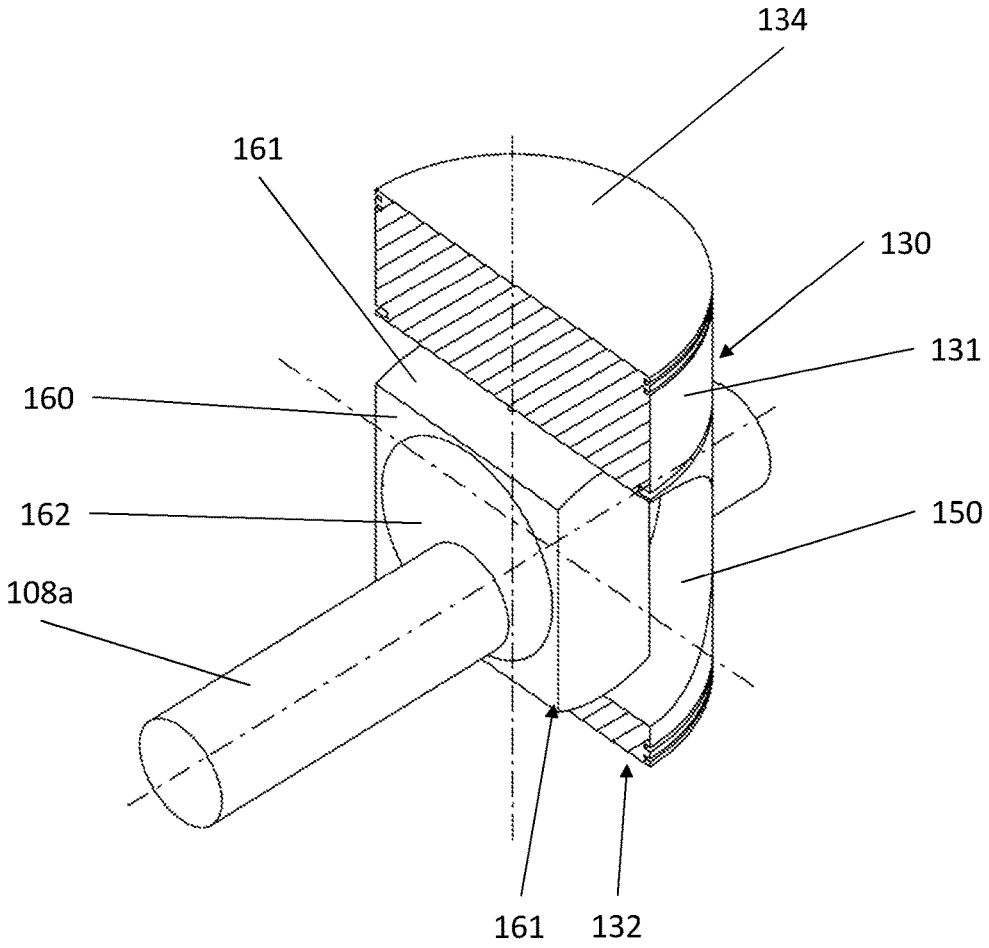
Figure 7:
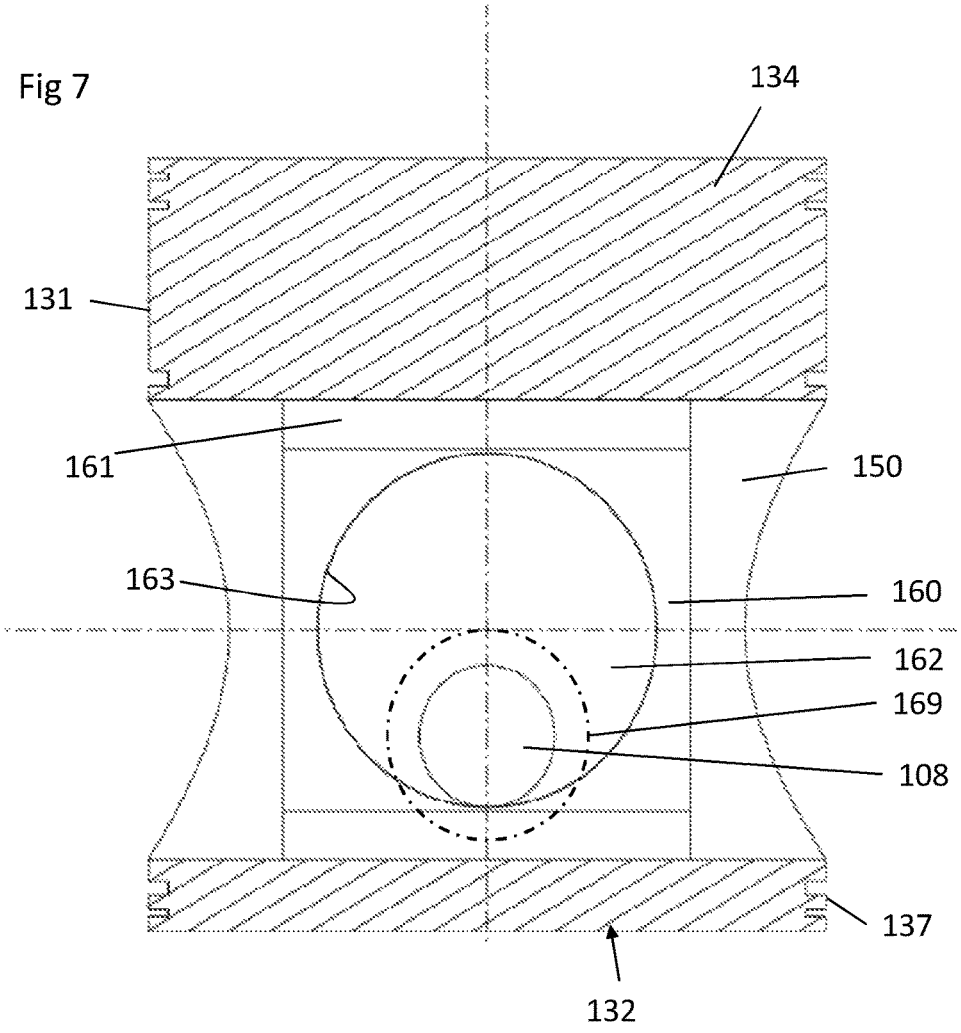

As best shown in FIGS. 6 and 7, the output shaft 108 has a main shaft portion 108*a* and an eccentric portion 162. The main shaft portion 108*a* is rotatably mounted on bearings (not shown) in the casing 107 and passes through the slot 151 of the piston 130. The eccentric portion 162 appears circular when viewed in the direction of the output shaft rotational axis. The eccentric portion 162 is rotatably mounted in the bore 163 of the sliding bearing 160.

The piston 130 is movable relative to the casing 107 in reciprocating motion between a top dead centre position (TDC), and a bottom dead centre position (BDC). TDC and BDC refer to specific positions of the piston during an operating cycle and apply irrespective of the orientation of the engine. When the piston 130 is at TDC the working face 134 of the combustion head 131 is at its closest position to the working face of the piston 140 so that the volume of the combustion chamber 112 is at its minimum and the volume of the scavenge chamber 113 is at its maximum. When the piston 130 is at BDC the working face 134 of the combustion head 131 is at its furthest position from the piston 140 so that the volume of the combustion chamber 112 is at its maximum and the volume of the scavenge chamber 113 is at its minimum.

As the piston 130 moves along its axis in reciprocating motion between TDC and BDC, the part-cylindrical bearing surfaces 161 of the sliding bearing 160 remain in sliding contact with the bore 150 of the piston 130, and the sliding bearing 160 moves with the piston in the direction of the piston axis. The eccentric portion 162 additionally causes the sliding bearing 160 to move relative to the piston along a movement path substantially transverse to the cylinder axis in reciprocating motion. The sliding bearing 160 generally follows a circular path 169 about the centre-line of the output shaft 108, and moves with the centre point of the rotating eccentric portion 162, as indicated in FIG. 7. The sliding bearing 160 and the piston 130 follow simple harmonic motion in the direction of the piston axis with respect to the angle of rotation of the output shaft 108.

The linear to rotary power transfer mechanism (including the bore 150 of the piston 130, the sliding bearing 160 and the output shaft 108) is substantially sealed from the intake system for the engine and is substantially sealed from the combustion chamber 112 and the scavenge chambers 111, 113 by the gas seal rings 136,138 and the oil seal rings 135, 139 such that the power transfer mechanism is self-contained within a power transfer assembly chamber of the piston.

Figure 8:
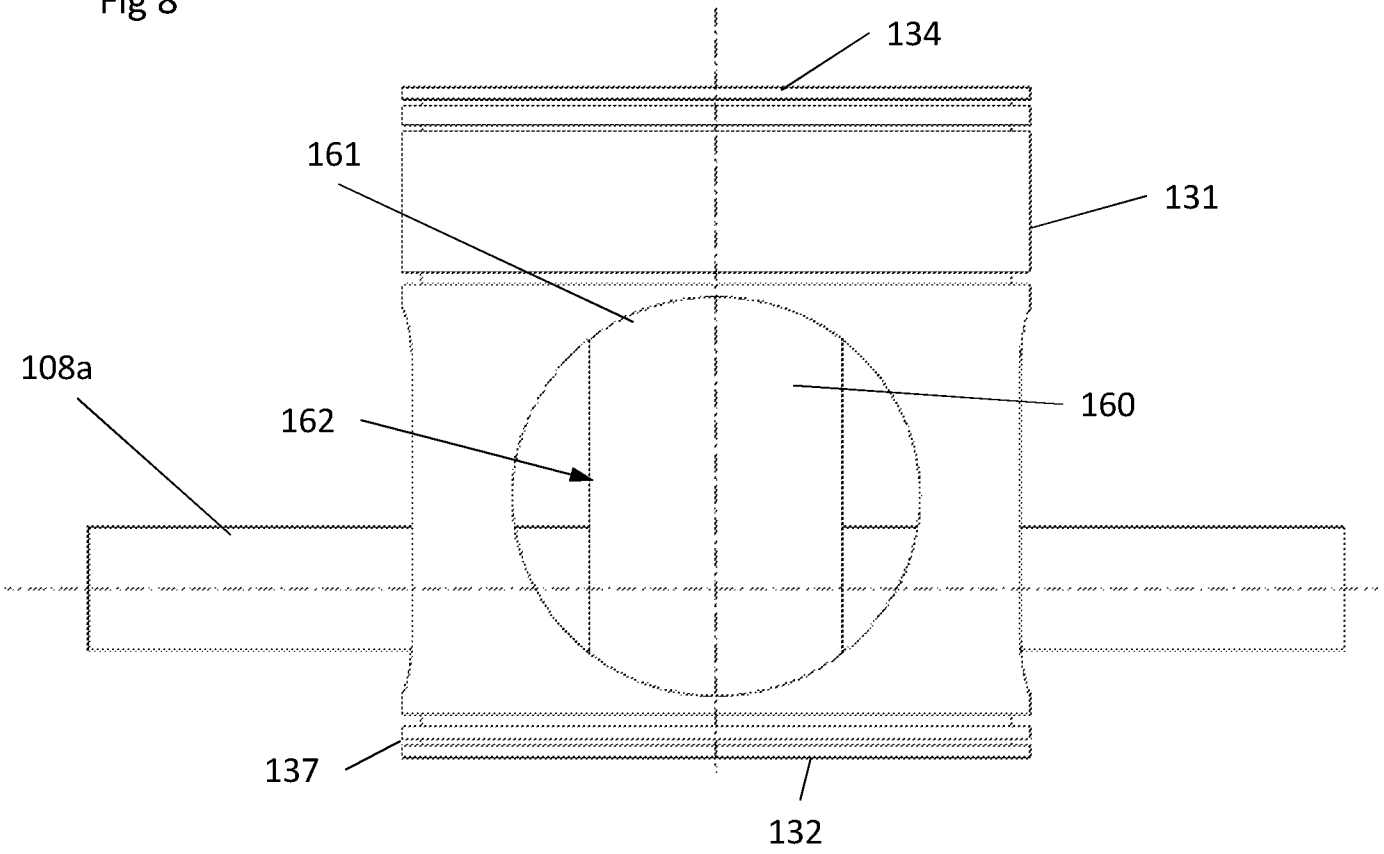
Figure 9:
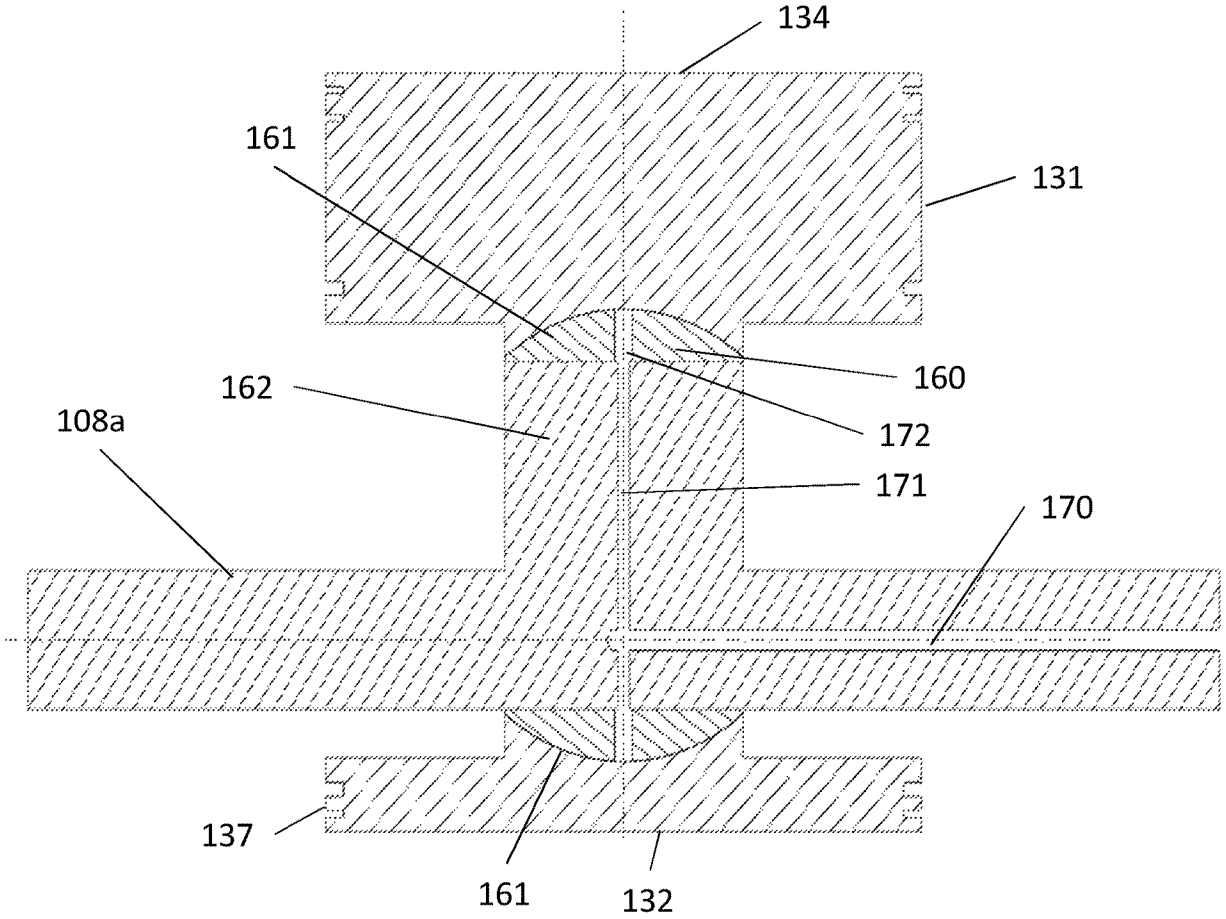

The engine has a lubrication system which lubricates the power transfer mechanism. Part of the lubrication system is shown in the cross section view of FIG. 9 taken along the centre-line of the output shaft 108. The lubrication system includes an oil supply line 170 passing through the main shaft portion 108*a* which is connected to oil feed lines 171 extending radially outwardly through the eccentric portion 162. The oil feed lines have outlets at the outer radial surface of the eccentric portion 162 through which oil is supplied to lubricate the interface between the eccentric portion and the bore 150 of the sliding bearing 160. The sliding bearing 160 has at least one oil transfer port 172 extending between the bore surface 163 and at least one of the part-cylindrical bearing surfaces 161, through which oil is supplied to lubricate the interface(s) between the bearing surfaces 161 and the bore 150 of the piston 130. The oil transfer ports 172 have outlets at the grooves 45*a* or 45*b*, as shown in FIG. 8. The lubrication system is dry sumped and includes a sump tank 120 (shown in FIG. 1). The lubrication system may also include wall mounted oil spray jets (not shown) which spray oil towards the power transfer mechanism.

Starting from BDC, the engine operates as follows:

a) As the piston moves from BDC to TDC the working face 132 of the scavenge head 137 moves away from the end of the scavenge chamber 113, thereby increasing the volume of the scavenge chamber. The increase in volume of the scavenge chamber 113 results in a decrease in pressure which causes one way valve to open and intake gases to be drawn from the intake duct into the scavenge chamber. The intake gases include intake air and fuel which is mixed with the intake air by a carburettor or throttle body and fuel injector (shown in FIG. 12) upstream of the scavenge chamber 113 to form a fuel/air mixture. Shortly after the piston leaves BDC the cylindrical outer surface of the combustion head 131 covers the outlet of the transfer port substantially preventing the movement of gases from the scavenge chamber 113 into the combustion chamber 112 through the transfer port.

b) As the piston reaches TDC and begins to move towards BDC the working face 132 of the scavenge head 137 moves towards the end of the scavenge chamber 113, thereby reducing the volume of the scavenge chamber and compressing the intake gases. The one way valve closes to substantially prevent the flow of intake gases from the scavenge chamber 113 back into the intake duct.

c) Shortly before the piston 130 reaches BDC the piston skirt of the combustion head 131 uncovers the outlet of the transfer port and the exhaust port. Due to a pressure differential between the combustion chamber 112 and the scavenge chamber 113, intake gases flow through the transfer port from the scavenge chamber 113 into the combustion chamber. The piston then reaches BDC and begins to move back towards TDC.

d) Shortly after the piston 130 leaves BDC the piston skirt of the combustion head 131 covers the outlet of the transfer port and the exhaust port. As the piston moves from BDC to TDC the working face 134 of the combustion head 131 moves towards the piston 140 in the combustion chamber 112, thereby compressing the intake gases.

e) As the piston approaches TDC the spark plug 115 produces a spark which ignites the fuel/air mixture of the intake gases. The intake gases then burn within the combustion chamber, resulting in an increase in pressure. The increased pressure due to combustion exerts a combustion force on the working surface 134 of the combustion head 131, forcing the piston back towards BDC in a power stroke. The combustion force is transmitted from the combustion head 131 through the reverse face and into the shuttle bearing 160 through the upper bearing surface 161 and thence into the eccentric portion 162, therefore applying a torque to the output shaft 108 so that the reciprocating motion of the piston 130 is converted into rotary motion of the output shaft.

f) As the piston approaches BDC the piston skirt of the combustion head 131 uncovers the outlet of the transfer port and the exhaust port. The burnt gases or exhaust gases are drawn out of the combustion chamber 112 through the exhaust port into the exhaust duct. Fresh intake gases which have been compressed in the scavenge chamber 113 during the power stroke are then drawn through the transfer port into the combustion chamber 112 displacing the exhaust gases.

The piston 140 operates identically.

Returning to FIG. 4, the alternative power transfer assembly including a rolling bearing will now be described. The piston 130 has the same basic construction to that described above with reference to FIG. 3 and like reference numerals have been used to denote like parts.

The power transfer assembly 110*b* includes a rolling bearing 260 received within the bore 150 and has a part spherical outer bearing surface 261 which engages the bore 150 of the piston 130.

Figure 10:
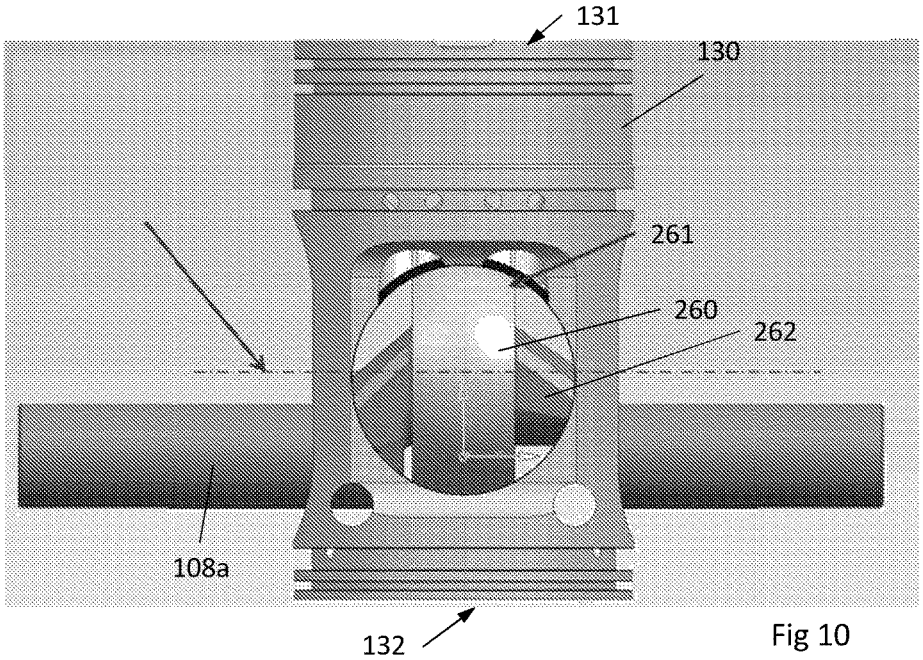
FIGS. 10 and 11 illustrate further views of the piston and power transfer assembly of FIG. 4 including a rolling linear motion bearing.
Figure 11:
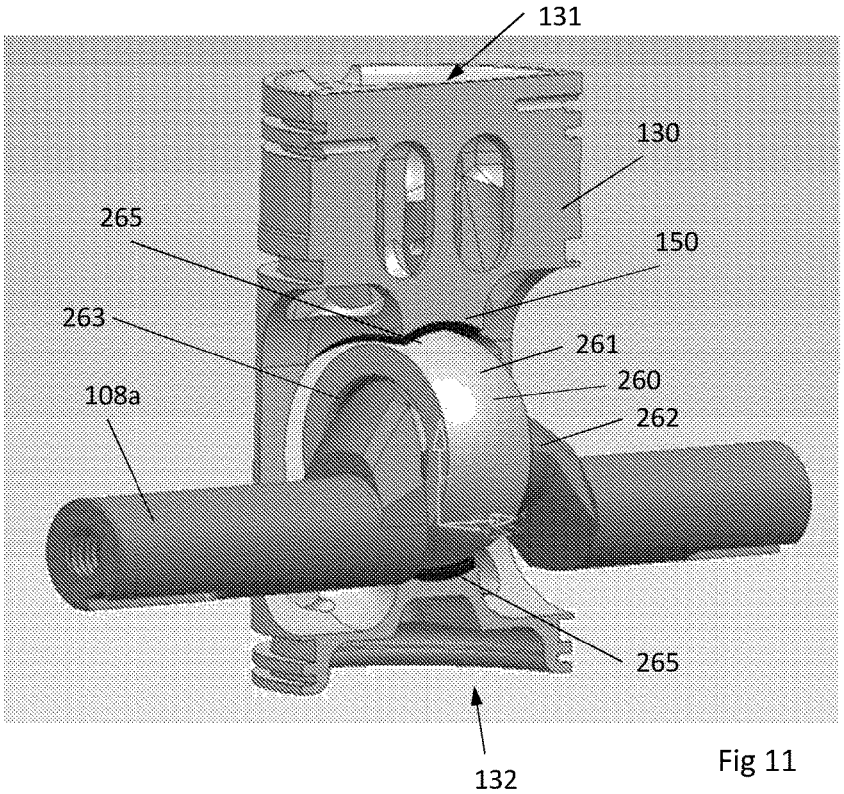

As best shown in FIGS. 10 and 11, the bore 150 has a part spherical bearing race 265 in positive contact with the part spherical outer bearing surface 261 of the rolling bearing 260. The rolling bearing 260 includes a bore 263 extending through its thickness and having an axis of rotation parallel to and spaced from the output shaft 108 axis of rotation. The output shaft 108 has a main shaft portion 108*a* and an eccentric crankpin 262. The main shaft portion 108*a* is rotatably mounted on bearings (not shown) in the casing 107 and passes through the slot 151 of the piston 130.

The piston 130 is movable relative to the casing 107 in reciprocating motion between a top dead centre position (TDC), and a bottom dead centre position (BDC). As the piston 130 moves along its in reciprocating motion between TDC and BDC, the part-spherical bearing surface 261 of the rolling bearing 160 remains in rolling contact with the part spherical bearing race 265 of the bore 150 of the piston 130, and the rolling bearing 260 revolves about the axis of the crankpin 262 whilst in rolling contact with the piston bore 150 (which is transverse to the piston's reciprocating axis). The crankpin 262 therefore causes the rolling bearing 260 to move relative to the piston along a movement path substantially transverse to the cylinder axis in reciprocating motion. The rolling bearing 260 generally follows a circular path about the centre-line of the output shaft 108, and moves with the centre point of the crank pin 262. The rolling bearing 260 and the piston 130 follow simple harmonic motion in the direction of the piston axis with respect to the angle of rotation of the output shaft 108.

The linear to rotary power transfer mechanism 110*b* is substantially sealed from the intake system for the engine and is substantially sealed from the combustion chamber 112 and the scavenge chambers 111, 113 by the gas seal rings 136,138 and the oil seal rings 135, 139 in the same way as described above for the linear to rotary power transfer mechanism 110*a*. Operation of the engine is also the same, regardless of the type of linear to rotary power transfer mechanism used.

The linear to rotary power transfer mechanisms described above provides a more compact, more robust and lighter weight linear to rotary motion coupling than the crankshaft and con rod arrangement of a standard two-stroke engine. This therefore allows an increase in strength and reduction in the size and weight of an engine so that power density and reliability is maximised. By moving the piston 130 relative to the casing 107 in simple harmonic motion, the engine allows increased TDC dwell time and reduced TDC piston acceleration compared to the conventional crankshaft and con rod driven engine. By increasing TDC dwell time combustion efficiency is increased, for example more complete combustion of the fuel in the combustion chamber is allowed to occur, so that fuel consumption is reduced and emissions of unburnt hydrocarbons are reduced. In addition spark advance may be reduced and the engine may be allowed to run at higher engine speeds, which allows for greater speed range without gears.

By reducing TDC piston acceleration, the engine experiences reduced piston acceleration spikes at TDC and therefore reduced component loading. Therefore design requirements are reduced, so that the weight of the engine may be minimised. This makes the engine particularly suitable for the outboard motor market and other weight sensitive applications. Reducing component loading also reduces wear rates and reduces the probability of early component failures, so the engine is more reliable, and has reduced maintenance requirements and repair costs.

Moving the piston 130 in simple harmonic motion (SHM) with respect to output shaft rotation also eliminates the difference in piston acceleration at TDC and BDC so that counterbalancing requirements at TDC and BDC are equalised. Furthermore, by arranging the pistons 130 and 140 in an opposed relationship the engine achieves near perfect balance. The opposed piston arrangement also improves thermal efficiency.

However, the effect of this SHM motion on engine balance may be mostly appreciated in a non-opposed piston configuration where there is no opposing piston to cancel the other's acceleration. For example, two output shafts of the engine may desirably be driven out of phase with only relatively small induced engine imbalance (that could be counteracted through rotary counterbalance weights). This presents the opportunity to both open and close the exhaust port earlier, which will assist with engine efficiency because the timing difference may be optimized to minimise short circuiting, perhaps to such an extent where direct fuel injection systems are not necessary.

FIGS. 12*a* to 12*g* shows an enlarged cut-away view of the internal combustion engine 105 looking along the respective output shafts 108, 109. The operation of the first and second pistons 130, 140 arranged in an opposed configuration can be seen from TDC (FIG. 12*a*) to BDC (FIG. 12*e*) and the return towards TDC. The first piston 130 houses the intake power transfer assembly and second piston 140 houses the exhaust power transfer assembly. The opposed pistons 130, 140 are operated out of phase as will be described below.

Intake port 130*a* is provided in the engine casing 107, communicating with the right hand side of the combustion chamber 112 of the cylinder 106. Exhaust ports 140*a* are provided in the engine casing 107, communicating with the left hand side of cylinder 106.

Figure 12A:
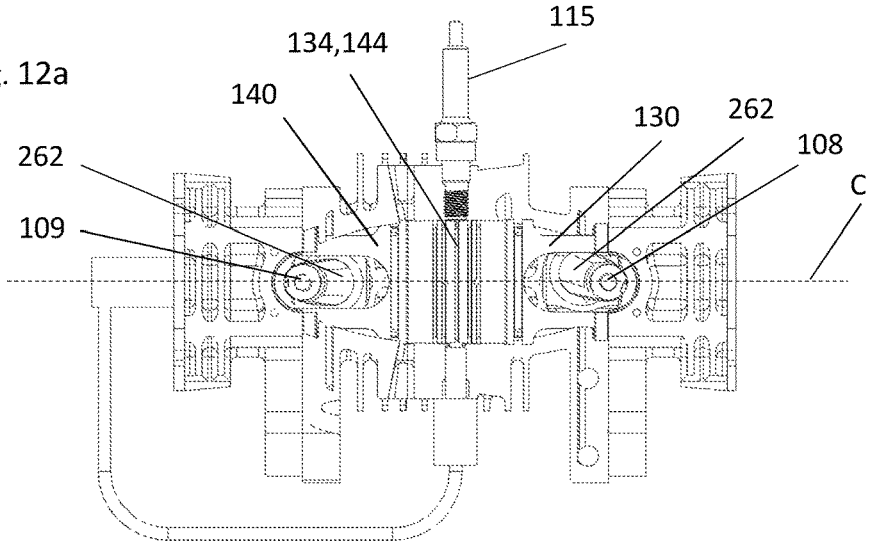

As shown in FIG. 12*a*, the rolling bearing 260 of the first piston 130 power transfer assembly is arranged such that the eccentric crank pin 262 is at −20 degrees to the cylinder axis C whilst the rolling bearing 260 of the second piston 140 power transfer assembly is arranged such that the eccentric crank pin 262 is at 0 degrees to the cylinder axis C. The working face 134 of first piston 130 is at its closest position to the working face 144 of second piston 140, so that the volume of the combustion chamber 112 is at its minimum, in the TDC position.

Figure 12B:
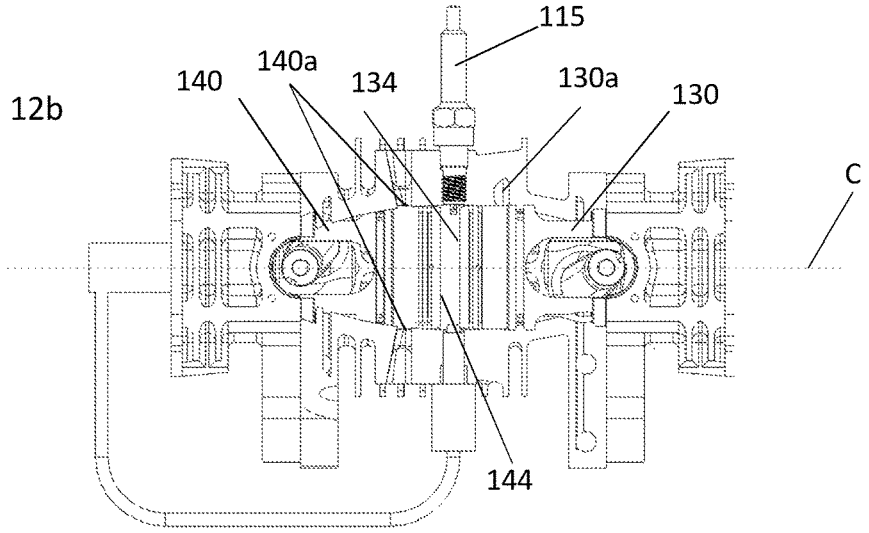

After 45 degrees of rotation, the eccentric crank pin 262 of the first piston 130 is at 25 degrees to the cylinder axis c, whilst the eccentric crank pin 262 of the second piston 140 is at 45 degrees to the cylinder axis c, (see FIG. 12*b*).

Figure 12C:
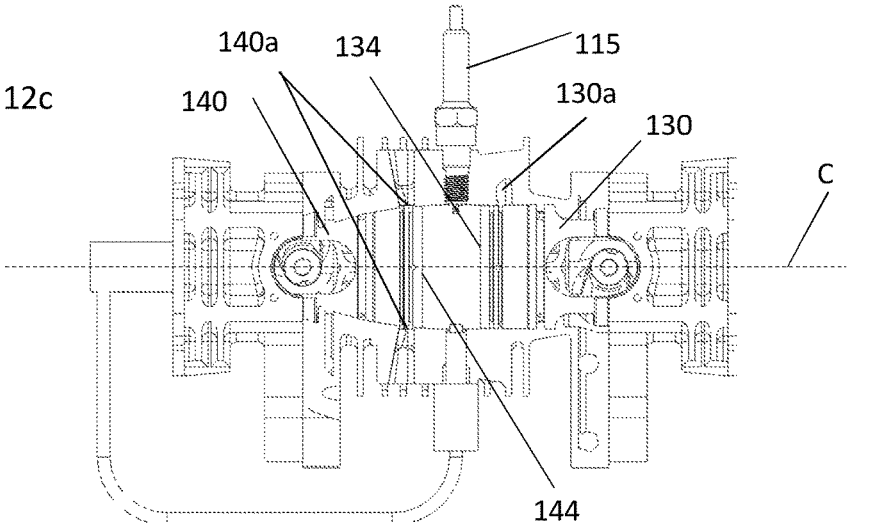

After a further 45 degrees of rotation, the eccentric crank pin 262 of the first piston 130 is at 70 degrees to the cylinder access c, whilst the eccentric crank pin 262 of the second piston 140 is at 90 degrees to the cylinder access C (see FIG. 12*c*).

Figure 12D:
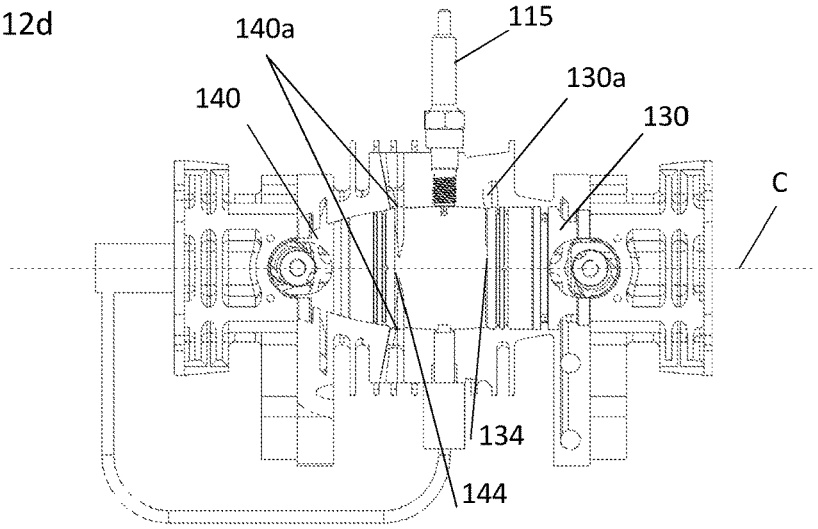

After a further 45 degrees of rotation, the eccentric crank pin 262 of the first piston 130 is at 115 degrees to the cylinder access c, whilst the eccentric crank pin 262 of the second piston 140 is at 135 degrees to the cylinder access C (see FIG. 12*d*). Exhaust ports 140*a* are exposed to the combination chamber 112 by the withdrawing second piston 140 whilst the intake port 130*a* is still covered by the first piston 130.

Figure 12E:
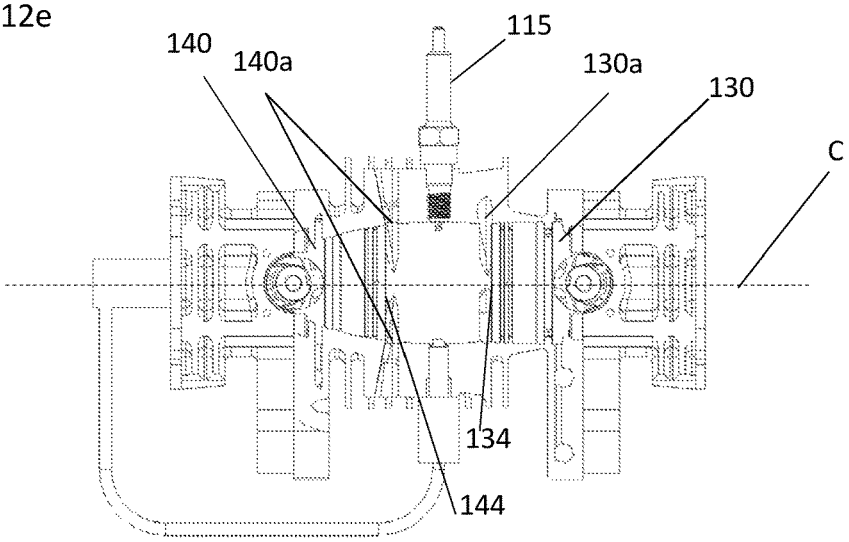

After a further 45 degrees of rotation, the eccentric crank pin 262 of the first piston 130 is at 160 degrees to the cylinder access c, whilst the eccentric crank pin 262 of the second piston 140 is at 180 degrees to the cylinder access C (see FIG. 12*e*). The working face 134 of the first piston 130 is at its furthest position to the working face 144 of the second piston 140, so that the volume of the combustion chamber 112 is at its maximum, in the BDC position. Both the exhaust ports 140*a* and the intake port 130*a* are exposed to the combustion chamber 112.

Figure 12F:
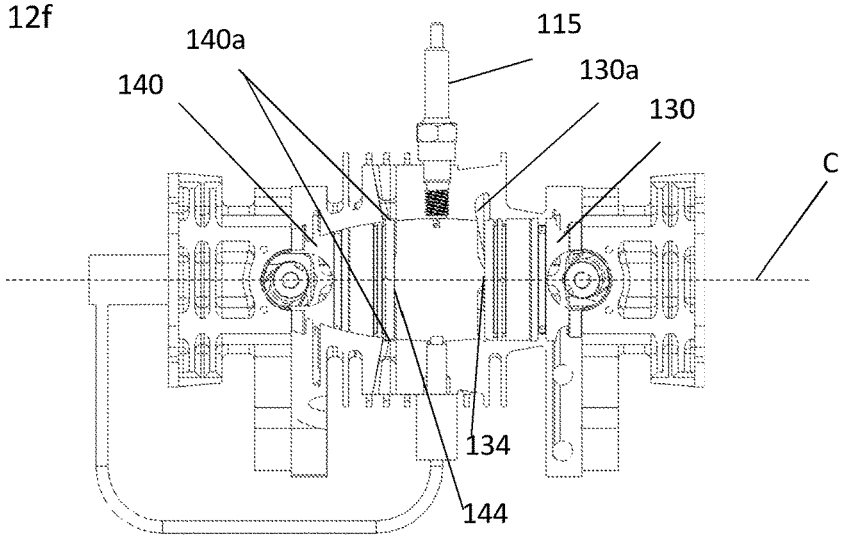

After a further 45 degrees of rotation, the eccentric crank pin 262 of the first piston 130 is at 205 degrees to the cylinder access c, whilst the eccentric crank pin 262 of the second piston 140 is at 225 degrees to the cylinder access C (see FIG. 12*f*). Exhaust ports 140*a* are covered by the advancing second piston 140, whilst the intake port 130*a* is still exposed to the combustion chamber 112.

After a further 45 degrees of rotation, the eccentric crank pin 262 of the first piston 130 is at 250 degrees to the cylinder access c, whilst the eccentric crank pin 262 of the second piston 140 is at 270 degrees to the cylinder access C (see FIG. 12*g*). Both the exhaust ports 140*a* and the intake port 130*a* are covered by the respective second and first pistons 140, 130.

Thus, the opening and closing of the exhaust ports 140*a* is advanced ahead of the intake port 130*a*, by shifting the crank pins 262 out of phase, to deviate from symmetrical exhaust and intake timing which may contribute to a reduction in the short circuiting associated with conventional 2-strokes.

The piston thrust load caused by a conventional crankshaft and con-rod mechanism is roughly halved by the geometry of the sliding bearing arrangement.

By reducing or eliminating piston side loads the invention reduces frictional losses of the engine so that efficiency is increased and reduces wear rates of the piston and cylinder side walls so that reliability is improved and maintenance costs are minimised.

Due to the lubrication of the power transfer mechanism in isolation from the intake system, the engine does not require a total loss lubrication system as operated for conventional two-stroke engines. The engine can therefore operate using a wide variety of fuels, including gaseous phase fuels, which are not lubricant bearing. The emissions from the engine are therefore significantly lower than for a conventional two stroke engine since oil is not passed out of the engine with the exhaust gases. This provides surprisingly good synergy for outboard motor applications, where recent trends have moved away from conventional two-stroke engines due to their higher emissions.

The part-cylindrical sliding bearing surfaces 161, or the part spherical rolling bearing surface 261, allows the linear motion bearings to at least partially rotate about an axis transverse to the piston axis within the piston bore 150. This allows the linear motion bearing to maintain good contact with the piston in the case of slight misalignment of any of the components in the power transfer assembly. The power transfer assembly is therefore more tolerant of misalignment.

In an alternative embodiment the sliding bearing may have one or more part-spherical bearing surfaces allowing rotation about both an axis parallel to the direction of reciprocating motion of the sliding bearing relative to the piston and an axis perpendicular to the piston axis and perpendicular to the direction of movement of the sliding bearing relative to the piston. This gives the combined advantage of increased tolerance of misalignment and wear of components and also increased TDC dwell time.

FIG. 13*a* illustrates an air assisted fuel injection pump for use with any of the engine variants described above. FIG. 13 shows a piston 330 coupled to an output shaft 308 via a linear to rotary power transfer mechanism 310 including the rolling bearing identical to that described above with reference to FIGS. 4, 10 and 11. Equally, the sliding bearing variant may be utilised or any other suitable linear motion bearing power transfer mechanism. The engine has an air intake 301 opening into a scavenge chamber 311, an exhaust outlet 302 open from a combustion chamber 312, and a transfer conduit 303 extending between the scavenge chamber 311 and the combustion chamber 312.

The "cold" second head 331 of the piston is mechanically coupled to pump 400. The pump 400 includes a piston 401 arranged for reciprocating motion in a cylinder 402. The cylinder has an air intake port 403, and a compressed air exhaust port 404 coupled to a high pressure transfer conduit 405. The other end of the high pressure transfer conduit 405 opens in air assisted direct fuel injector 406 having a fuel inlet 407.

Figure 13B:
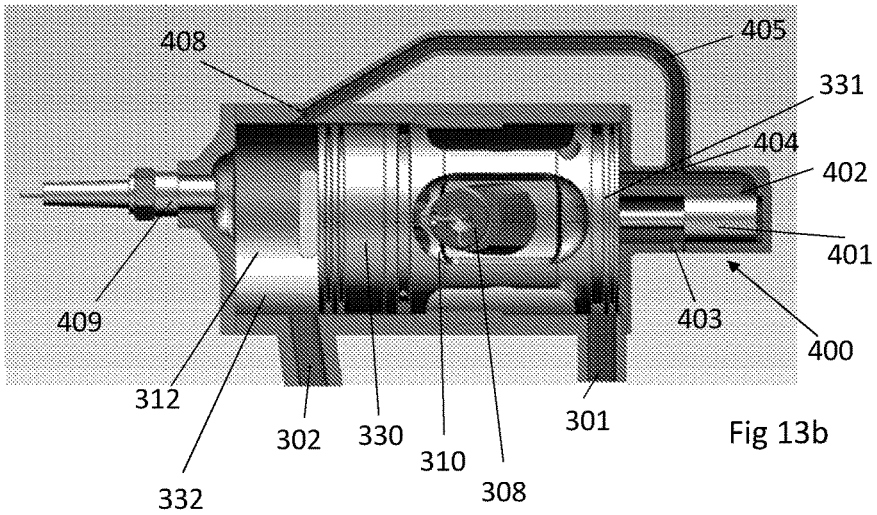
FIG. 13*b* illustrates a semi direct fuel injection pump for use with the engine.

An alternative embodiment of the fuel injection pump for use with any of the engine variants described above is illustrated in FIG. 13*b*. Like reference numerals are used to denote like parts. In FIG. 13*b* the other end of the high pressure transfer conduit 405 exhausts via a fuel injection port 408 which is aimed specifically towards a spark plug 409 to minimize short circuiting and to maximize fuel/air mixing. The fuel injection port 408 may be effectively delayed by a restrictive orifice so to minimize the emission of unburnt hydrocarbons through short circuiting.

The fuel injection port 408 may be fed both air and fuel to promote full mixing. This may also be used to create lean burn capability where a locally rich portion of fuel/air mixture may be aimed at the combustion chamber 312 reducing the requirement to throttle the intake in low power requirement situations.

As the piston 330 moves in reciprocating motion within the cylinder the pump 400 is driven to supply air at high pressure to the air assisted direct fuel injector 406. As is known in the art, direct injection allows the fuel to be injected only after the piston has risen to shut the exhaust port, thereby eliminating the emission of a majority of unburnt hydrocarbons. This helps combat the problem of short circuiting prevalent in conventional two stroke engines whereby unburnt hydrocarbons are able to exit the exhaust. The pressure of air in the transfer conduit 405 is typically higher than the pressure of air in the transfer conduit 303, but is not necessarily so.

In an alternative embodiment, the pump 400 is driven to supply a gaseous fuel at high pressure to the injection port 408 to provide semi-direct injection, whereby the injection port 408 is deliberately positioned and aimed to minimize fuel short circuiting. The diameter of port 408 may be sized to restrict flow causing injection to take place at the latter end of the injection port's open duration which in turn minimizes fuel short circuiting. The volume of gas injected may be dictated by the swept volume of the positive displacement pump 400 and may be adjusted by meanings of a throttle valve position in the intake of pump 400.

By using the second head 331 of the piston 330 to directly drive the small bore pump 400, rather than driving an air compressor from the output shaft, the frontal area of the engine remains small making it particularly suitable for streamlined engine applications such as for an outboard motor.

By sizing the pump piston 401 diameter to deliver a gaseous fuel at stoichiometric ratio, electronic fuel injection systems and conventional carburettors can be avoided.

By positioning the injection port 408 lower in the cylinder than the exhaust port 302, the cylinder pressure may be partially or completely exhausted meaning the injection port is not exposed to high combustion pressure and may not require either mechanically controlled or electronically controlled valving.

Although FIGS. 13*a* and 13*b* each illustrate a single piston it will be appreciated that the air assisted fuel injection pump or the semi direct fuel injection pump may be used with the opposed piston arrangement of FIG. 2.

In an alternative arrangement the pump may be mechanically coupled to the second head of the piston may be used to provide a supply of compressed air, or other gas, for other uses than the direct fuel injector.

Figure 14:
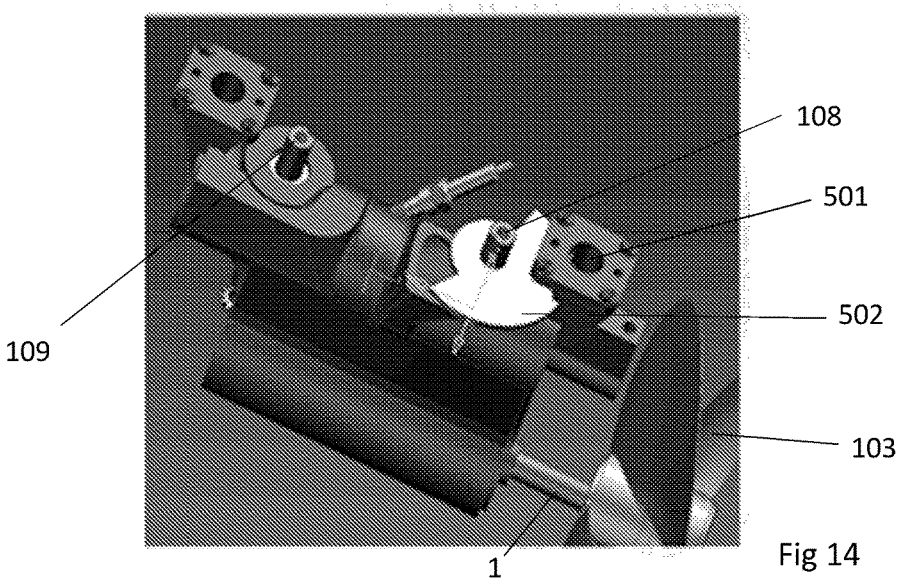
FIGS. 14 and 15 illustrate a rotary disc timing valve for use with the engine.
Figure 15:
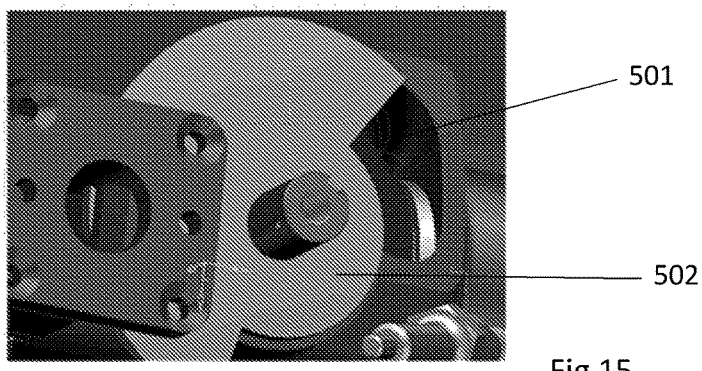

FIGS. 14 and 15 illustrate a rotary disc timing valve for use with the engines described above. As mentioned previously, conventional two stroke engines suffer from short circuiting, due to their limitation of symmetrical exhaust open/close timing, unburnt hydrocarbons can escape. The compactness of engines described above brings the exhaust port 501 very close to the output shaft 108 making it practical to use a rotary disc exhaust timing valve 502 to close the exhaust port at the optimum time. By optimising the timing of the exhaust valve opening, emissions reductions may be achieved without expensive components or complex assemblies with numerous components. In addition, the disc valve benefits from the use of gaseous fuel because there is reduced particular matter in the exhaust gasses minimizing wear. The rotary disc exhaust timing valve therefore provides surprising synergy with various other aspects of the engines described above.

Figure 16:
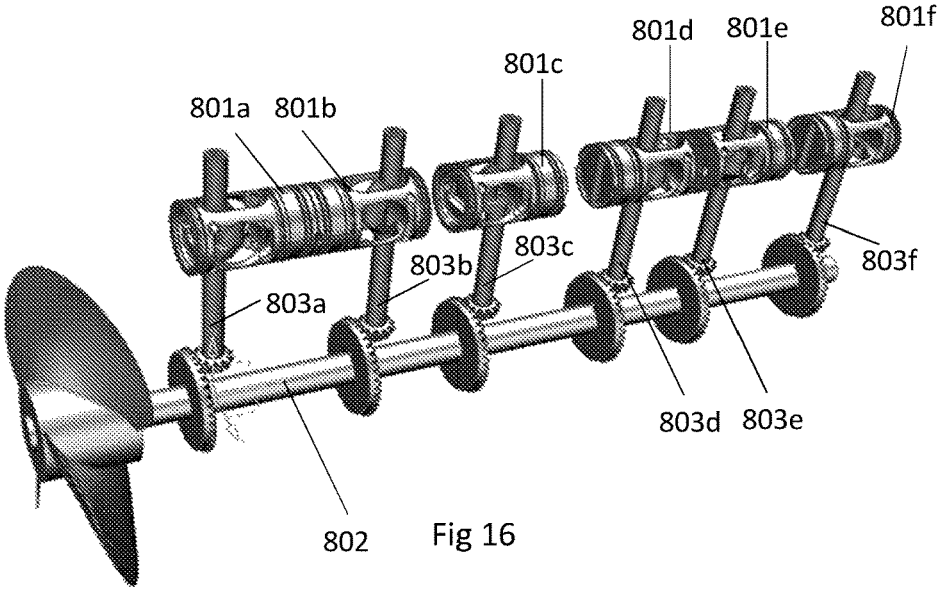
FIGS. 16 and 17 illustrate alternative piston arrangements for use in an outboard motor application.
Figure 17:
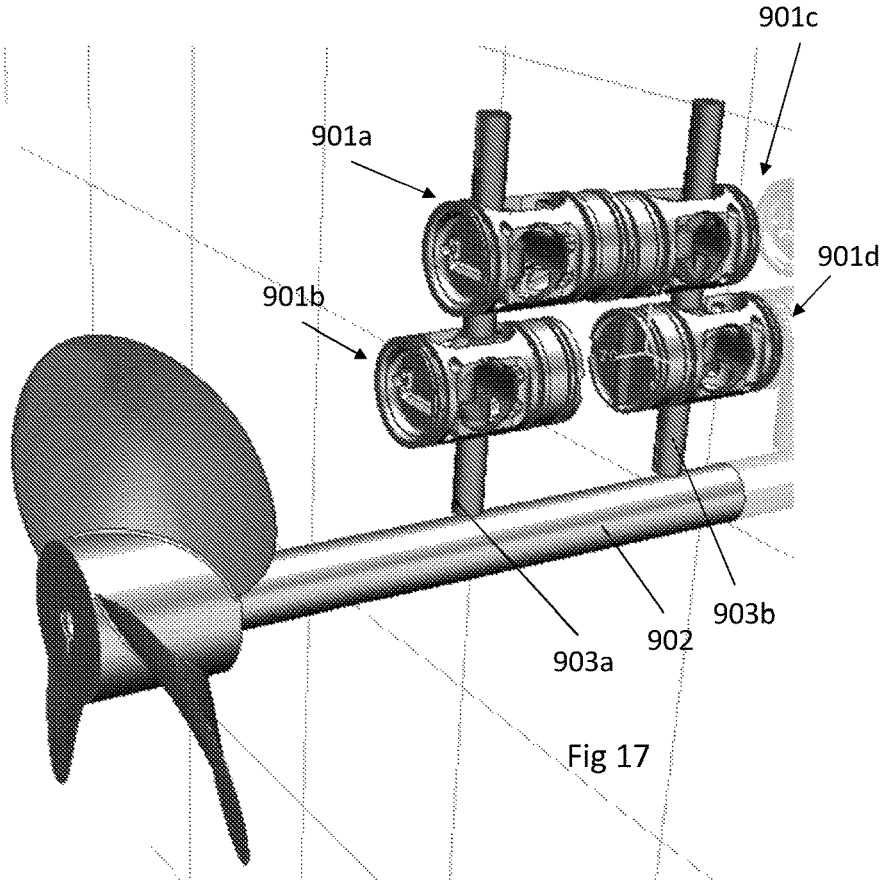

FIGS. 16 and 17 illustrate alternative piston arrangements for use in an outboard motor application, illustrating the excellent scalability of the engine design. From FIG. 16 it can be seen that a large number (in this case six) pistons 801*a-f* may be arranged in series driving a single propeller shaft 802, without increasing the frontal area of the engine as compared with the engine of FIGS. 1 and 2. Each piston 801*a-f* is coupled via a respective power transfer assembly to a respective output shaft 803*a-f*. The output shafts 803*a-f* transfer torque to the propeller shaft 802 via bevel gears as previously. The pistons are arranged in an opposed relationship such that the first heads of adjacent pistons are facing and the second heads of adjacent pistons are facing. This gives rise to sharing of combustion chambers of alternate pistons. As before, the single common propeller shaft provides mechanical synchronisation for timing each of the pistons 801*a-f*, ensuring excellent engine balance and minimal engine vibration.

FIG. 17 illustrates a further alternative, where multiple pistons are coupled to a common output shaft. Pistons 901*a* and 901*b* are arranged to drive output shaft 903*a*, whereas pistons 901*c* and 901*d* are arranged to drive output shaft 903*b*. Pistons 901*a* and 901*c* are arranged in an opposed relationship sharing a common combustion chamber. Pistons 901*c* and 901*d* are arranged in an opposed relationship with their scavenge chambers facing each other (but not shared). The output shafts 903*a* and 903*b* are again coupled to a common propeller shaft (e.g. via bevel gears, not shown).

Figure 18:
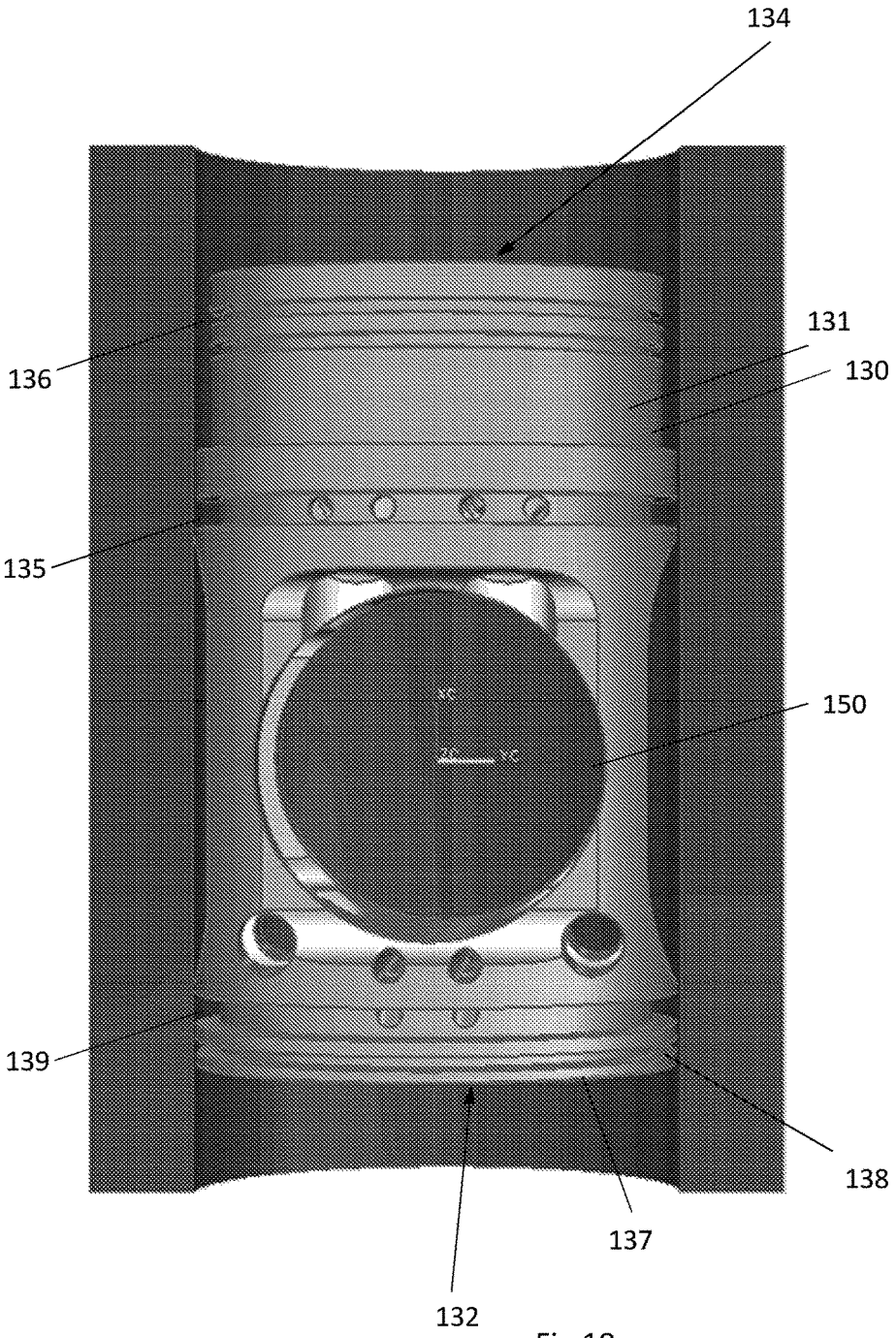
FIG. 18 in the different piston-to-bore clearances adopted along the length of the piston.

FIG. 18 illustrates in detail the piston 130 of the engines described above, so as to illustrate the different piston-to-bore clearances that may be adopted along the length of the piston. Conventional pistons have become more disc like over the years due to advantages gained in general compactness and reduced reciprocating mass. However, this introduces challenges in terms of piston stability, and generally prompting tight piston-to bore clearances. The dual sided piston on the other hand is naturally stable enabling generous clearances, where desired.

As shown in FIG. 18, the "hot" end of the piston in the region of the first head 131 has a generous piston-to-bore clearance. The dual ended piston is more tolerant of excessive clearance in this region because of the elongated stabilizing portion of the piston reverse of the hot-crown. The region extending approximately between the first and second oil ring seals 135, 139 has a tighter piston-to-bore clearance. The dual ended piston naturally elongates this close fitting diameter so piston rock is minimized.

An added advantage to this is the absence of any thrust load in the region of the cylinder ports, conventional 2-stroke engines must position their cylinder ports to avoid the piston being thrust towards a large port such as the exhaust port. The region extending between oil ring seals 135, 139 bares all thrust loads meaning the cylinder ports' positions may be uncompromised and piston wear is minimized due to the availability of an uninterrupted portion of the cylinder bore.

Figure 20:
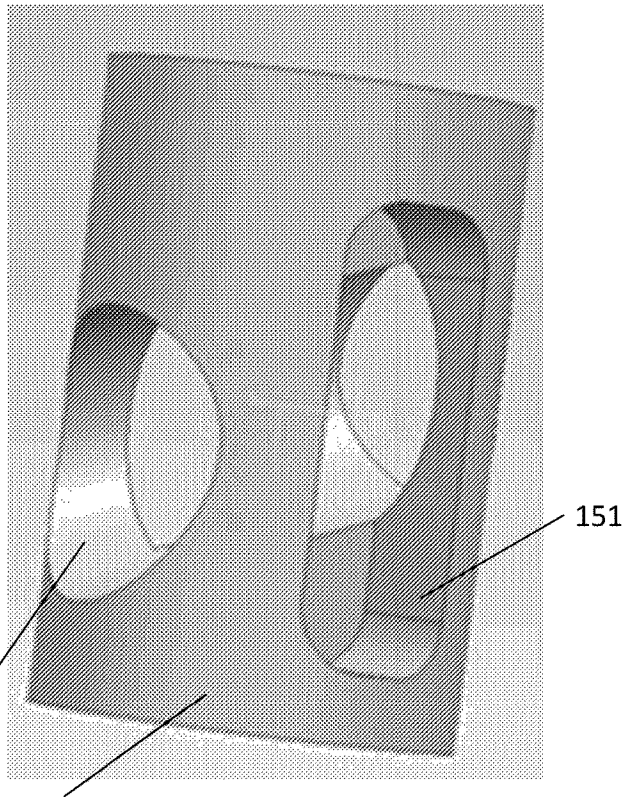
FIGS. 19 and 20 a further variant of the piston where the bore is inclined at an angle to the piston axis.
Figure 19:
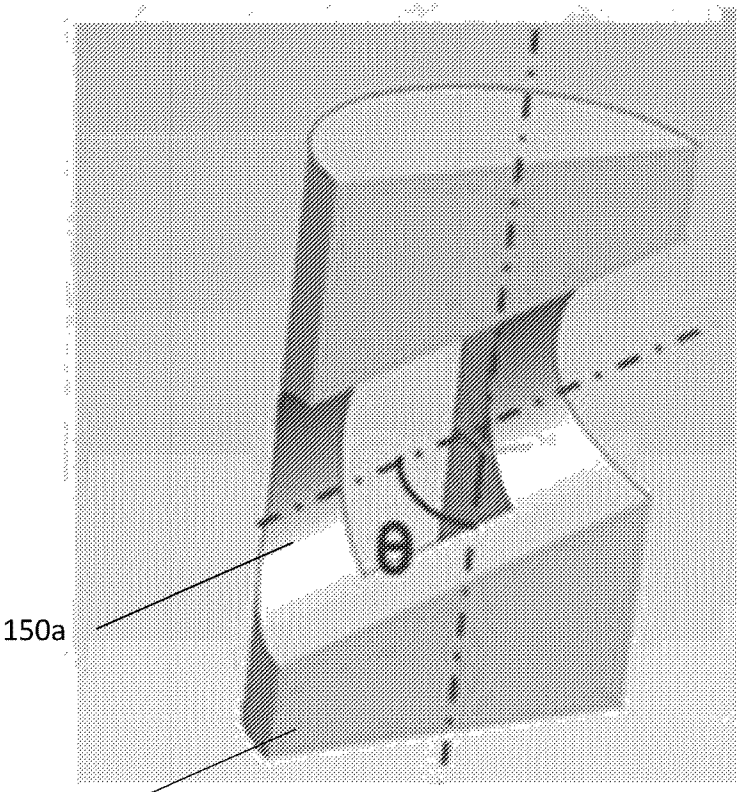

FIGS. 19 and 20 illustrate a further variant of the piston 130*a*, where the bore 150*a* is inclined at an angle, theta, to the piston axis that is substantially less than 90 degrees. In this manner the linear motion sliding bearing (not shown) is arranged to move in reciprocating motion with respect to the piston along a linear axis substantially inclined with respect to the cylinder axis.

In the above embodiments, the engines operate on a two-stroke cycle with a dual ended piston having a first head moveable within a combustion chamber and a second head moveable within a scavenge chamber. In an alternative embodiment, the dual ended piston may have a first head moveable within a first combustion chamber and a second head moveable within a second combustion chamber, with an external supercharger arranged to supply inlet air to the first and second combustion chambers alternately. FIGS. 21*a-h* illustrate a single cycle of the engine 1000.

The piston 1001 has a first head 1002, a second head 1003 moveable in a cylinder 1004 defining a first combustion chamber 1005 and a second combustion chamber 1006. A linear motion bearing power transfer assembly, such as the rolling bearing described previously, converts linear piston motion to rotary motion of the output shaft 1007. The combustion chambers 1004, 1005 have respective intakes 1008, 1009 coupled to a supercharger 1010, and respective exhausts 1011, 1012.

Figure 21B:
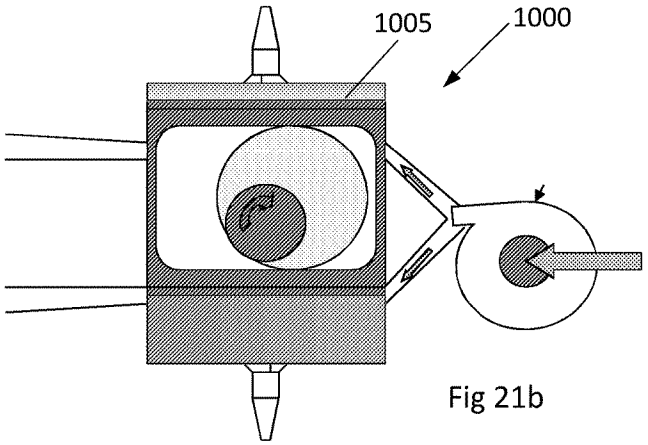
FIGS. 21*a-h* illustrate a cycle of an alternative engine with a dual ended piston, first and second combustion chambers, and an external supercharger.
Figure 21D:
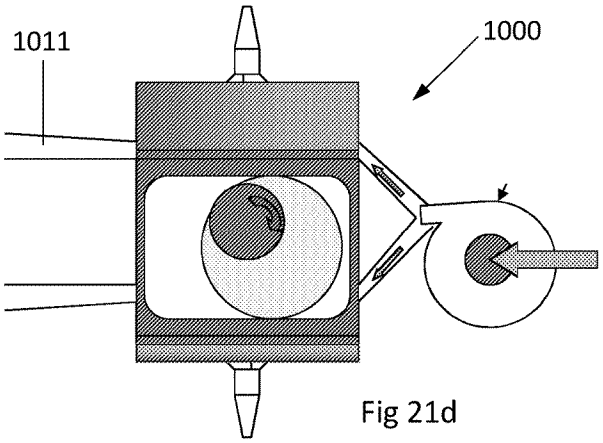
Figure 21A:
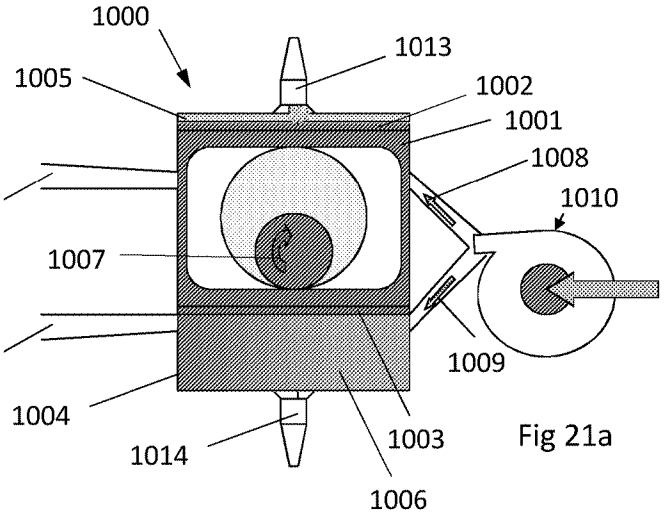
Figure 21C:
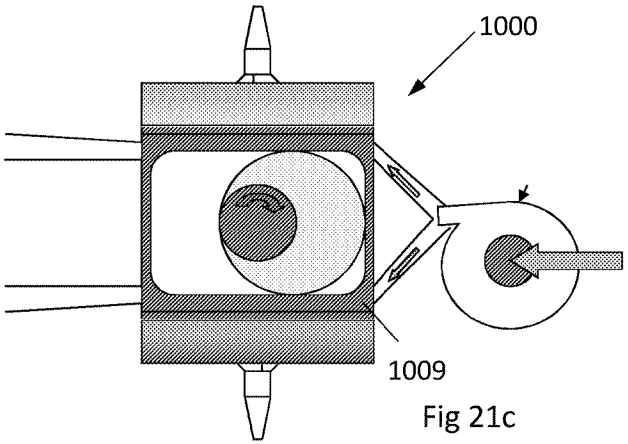
Figure 21F:
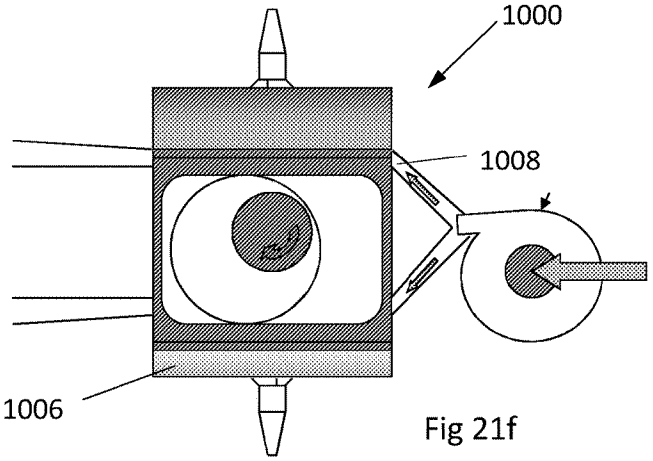
Figure 21H:
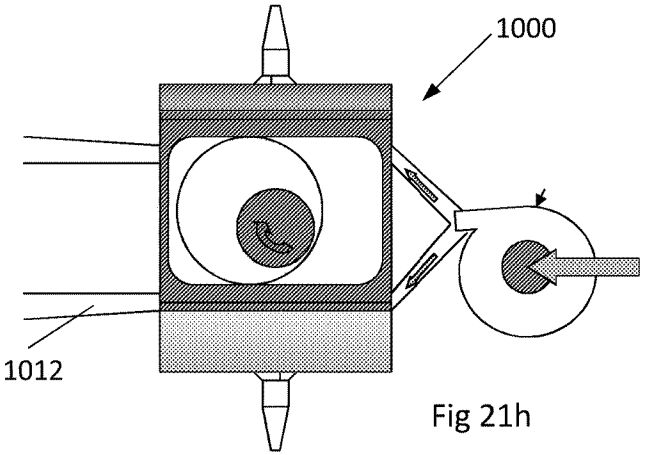
Figure 21E:
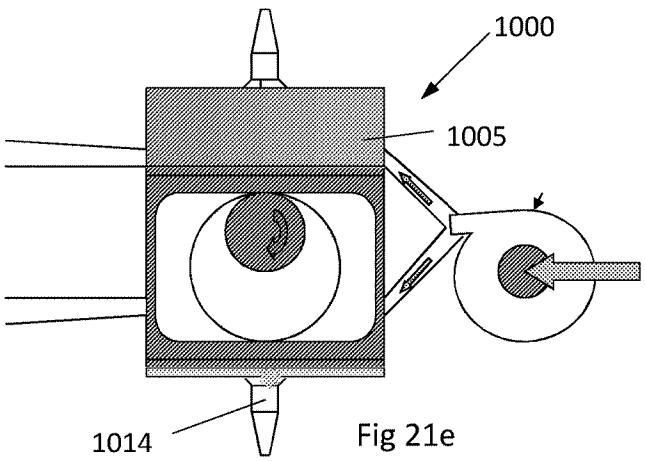
Figure 21G:
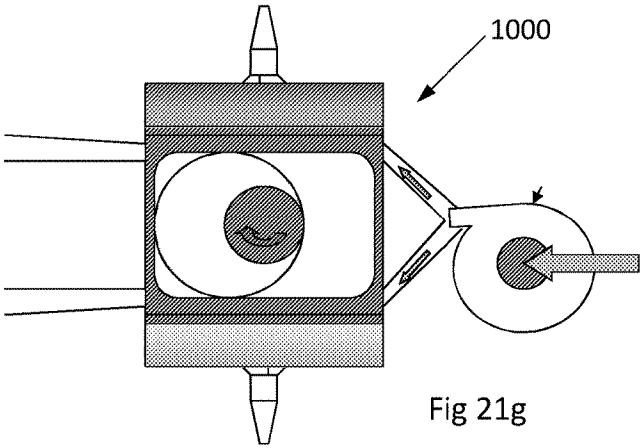

Starting from TDC at FIG. 21*a*, a first spark plug 1013 ignites the charge in the first combustion chamber 1005 whilst a fresh charge is being fed to the second combustion chamber 1006. The burning charge in the first combustion chamber 1005 causes downward motion of the piston 1001 in a first power stroke at FIG. 21*b* until the piston closes the intake 1009 to the second combustion chamber 1006 at FIG. 21*c*. Continued downward motion of the piston 1001 compresses the charge in the second combustion chamber 1006 whilst the first exhaust 1011 opens to evacuate burnt gases from the first combustion chamber at FIG. 21*d*. At BDC, shown in FIG. 21*e*, the second spark plug 1014 ignites the charge in the second combustion chamber 1006 whilst a fresh charge is being fed to the first combustion chamber 1005. The burning charge in the second combustion chamber 1006 causes upward motion of the piston 1001 in a second power stroke at FIG. 21*f* until the piston closes the intake 1008 to the first combustion chamber 1006 at FIG. 21*g*. Continued upward motion of the piston 1001 compresses the charge in the first combustion chamber 1005 whilst the second exhaust 1012 opens to evacuate burnt gases from the second combustion chamber at FIG. 21*h*. The cycle repeats.

The piston 1001 may have a first piston-to-bore clearance between the first head and the cylinder that is greater than a second piston-to-bore clearance extending between a region adjacent the first oil seal to a region adjacent the second oil seal. A third piston-to-bore clearance between the second head and the cylinder may be greater than the second piston-to-bore clearance.

The engine 1000 may be used in conjunction with any of the other aspects of the invention described above in any combination. In particular, the linear motion bearing power transfer assembly may employ the sliding bearing described previously with reference to FIGS. 5 to 9 rather than a rolling bearing.

The engine 1000 may be used in a propulsion unit for a water craft, for example. The small power dense engine 1000 is submerged to provide an abundance of cooling water which helps to meet the cooling demands of a dual sided piston receiving hot combustion gas twice per crankshaft revolution. The external supercharger is situated above the water line W and may be driven by one or more crankshafts vertically extended up to the supercharger.

Figure 22A:
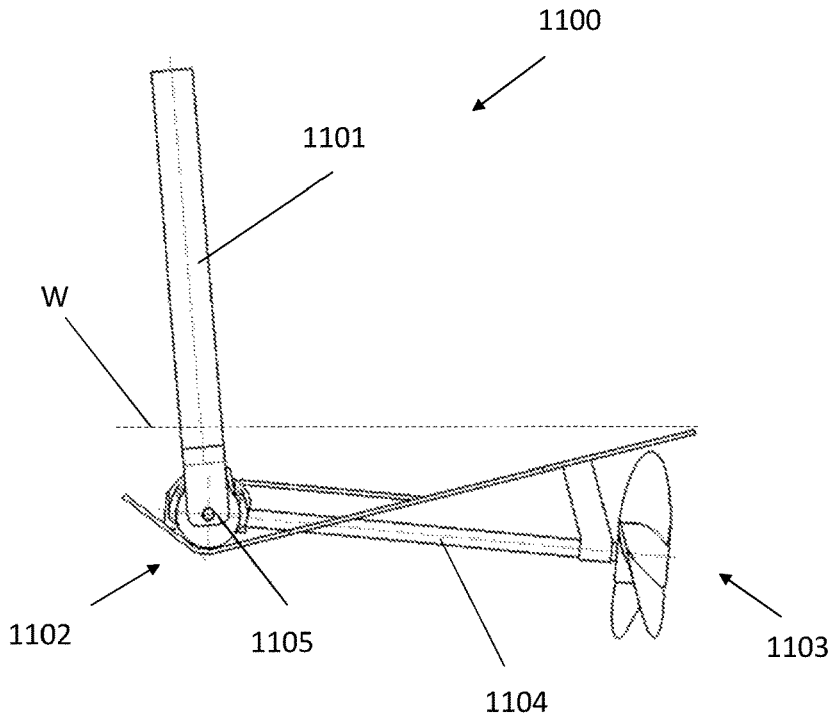
FIG. 22*a* illustrates a side elevation of another outboard motor for a water craft.
Figure 22B:
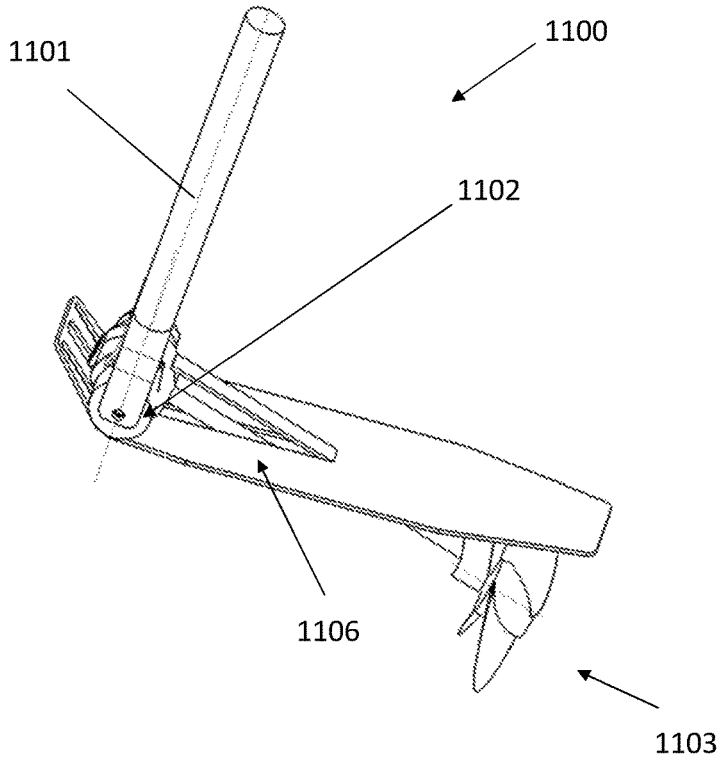
FIG. 22*b* illustrates a perspective view of the outboard motor of FIG. 22*a*.

FIGS. 22*a* and *b* illustrate an alternate outboard motor 1100 for a water craft. The outboard 1100 includes a steering post 1101 which extends from a rear transom of a water craft (not shown) below an intended water level W (when in use), and a submerged internal combustion engine and reduction drive 1102 generally below the water level W. An open propeller 1103 is coupled by an elongate drive shaft 1104 so as to be driven in rotation by the internal combustion engine and reduction drive 1102. The outboard motor 1100 additionally includes a hinged joint 1105, between the end of the steering post 1101 having the submerged internal combustion engine and reduction drive 1102 and the drive shaft 1104. Shielding, in the form of a bash guard 1106 is arranged between the hinged joint 1105 and the propeller 1103. The internal combustion engine 1102 is orientated by 90 degrees as compared to the internal combustion engine 102 of FIG. 2 as was described previously, such that its cylinder axis C is oriented perpendicularly to the axis of rotation of the propeller.

Thus, instead of the piston reciprocating in a plane substantially parallel to the direction of travel of the water craft, the pistons reciprocate substantially perpendicularly to the direction of travel. A spur reduction gear is used instead of bevel gears as in the previously disclosed embodiment.

The arrangement of outboard motor 1110, with the elongate drive shaft 1104 extending away from the transom, means that when navigating shallow waters, obstructions can be anticipated by helmsman and the drive shaft 1104 can be pivoted on the hinge joint 1105 so that the propeller 1103 is lifted out of the water, or clear of the obstruction, by pulling the steering post 1101 in the direction of travel. The provision of the bash guard 1106 means that if such obstructions are unnoticed, the internal combustion engine is afforded protection and the elongate drive shaft 1104 and propeller 1103 are urged towards the water level W, by the lift generated by the bash guard 1106 as it passes through the water.

Although the engines described above are described for use in an outboard motor for a water craft it will be appreciated that the engines described have wide applicability to a variety of applications. For example, the high power density, lightweight engines may be used in portable generators/range extenders, motorbikes/automotive, handheld tools, portable outdoor appliances/tools, aerospace, etc. The low frontal area of the engine may be particularly suited to small aircraft, for example.

Although the invention has been described above with reference to one or more preferred embodiments, it will be appreciated that various changes or modifications may be made without departing from the scope of the invention as defined in the appended claims.

The invention claimed is:

1. An internal combustion engine comprising a piston mounted for reciprocating linear motion within a cylinder along a cylinder axis, the piston is coupled to an output shaft by a power transfer assembly arranged to convert linear motion of the piston to rotary motion of the output shaft, the piston has a first head at one end of the piston and moveable within a first chamber and a second head at an opposite end of the piston and moveable within a second chamber, the power transfer assembly has a lubrication system for lubricating moving components of the power transfer assembly, wherein the lubrication system is sealed from the first chamber and the second chamber to prevent the passage of fluid from the lubrication system into the first chamber and the second chamber, wherein the power transfer assembly includes a linear motion bearing in positive contact with the piston, and wherein the linear motion bearing has a portion arranged to move relative to the piston along a linear axis substantially inclined with respect to the cylinder axis, and further wherein the linear motion bearing is a sliding bearing or a rolling bearing.

2. An internal combustion engine according to claim 1, wherein the linear motion bearing is coupled to the piston via a non-planar bearing surface thereby allowing rotation of the linear motion bearing.

3. An internal combustion engine according to claim 1, wherein the power transfer assembly is arranged such that the output shaft is between the first head and the second head of the piston.

4. An internal combustion engine comprising a piston mounted for reciprocating linear motion within a cylinder along a cylinder axis, the piston is coupled to an output shaft by a power transfer assembly arranged to convert linear motion of the piston to rotary motion of the output shaft, the piston has a first head at one end of the piston and moveable within a first chamber and a second head at an opposite end of the piston and moveable within a second chamber, the power transfer assembly has a lubrication system for lubricating moving components of the power transfer assembly, wherein the lubrication system is sealed from the first chamber and the second chamber to prevent the passage of fluid from the lubrication system into the first chamber and the second chamber, wherein the first chamber is a combustion chamber and the second chamber is a scavenge chamber arranged to supply inlet air to the combustion chamber.

5. An internal combustion engine comprising:

a piston mounted for reciprocating linear motion within a cylinder along a cylinder axis, the piston is coupled to an output shaft by a power transfer assembly arranged to convert linear motion of the piston to rotary motion of the output shaft, the piston has a first head at one end of the piston and moveable within a first chamber and a second head at an opposite end of the piston and moveable within a second chamber, the power transfer assembly has a lubrication system for lubricating moving components of the power transfer assembly, wherein the lubrication system is sealed from the first chamber and the second chamber to prevent the passage of fluid from the lubrication system into the first chamber and the second chamber; and a first oil seal between the piston and the cylinder on one side of the power transfer assembly, and a second oil seal between the piston and the cylinder on the other side of the power transfer assembly, wherein a first piston-to-bore clearance between the first head and the cylinder is greater than a second piston-to-bore clearance extending between a region adjacent the first oil seal to a region adjacent the second oil seal.

6. An internal combustion engine according to claim 4, further comprising a first transfer conduit extending between the scavenge chamber and the combustion chamber.

7. An internal combustion engine comprising a piston mounted for reciprocating linear motion within a cylinder along a cylinder axis, the piston is coupled to an output shaft by a power transfer assembly arranged to convert linear motion of the piston to rotary motion of the output shaft, the piston has a first head at one end of the piston and moveable within a first chamber and a second head at an opposite end of the piston and moveable within a second chamber, the power transfer assembly has a lubrication system for lubricating moving components of the power transfer assembly, wherein the lubrication system is sealed from the first chamber and the second chamber to prevent the passage of fluid from the lubrication system into the first chamber and the second chamber, and further comprising a pump driven by motion of the piston, wherein the pump is external to the cylinder.

8. An internal combustion engine according to claim 7, wherein the first chamber is a combustion chamber, and wherein the pump is arranged to supply pressurized gas to a fuel injection system having an outlet in the combustion chamber.

9. An internal combustion engine according to claim 8, further comprising a second transfer conduit extending between the pump and the fuel injection system.

10. An internal combustion engine according to claim 9, wherein the second transfer conduit is arranged to supply fuel to a fuel injection port.

11. An internal combustion engine according to claim 10, wherein the fuel injection port is configured to be sized to restrict the gas supplied by the second transfer conduit.

12. An internal combustion engine according to claim 6, further comprising a fuel injection system having an outlet in the combustion chamber and a second transfer conduit extending between the pump and the fuel injection system, wherein the second transfer conduit is arranged to convey gas at a higher pressure than the first transfer conduit.

13. An internal combustion engine according to claim 7, wherein the pump includes a reciprocating piston.

14. An internal combustion engine according to claim 13, wherein the reciprocating piston has a diameter sized to deliver a specific quantity of fuel for stoichiometric burn ratio.

15. An internal combustion engine comprising:

a piston mounted for reciprocating linear motion within a cylinder along a cylinder axis, the piston is coupled to an output shaft by a power transfer assembly arranged to convert linear motion of the piston to rotary motion of the output shaft, the piston has a first head at one end of the piston and moveable within a first chamber and a second head at an opposite end of the piston and moveable within a second chamber, the power transfer assembly has a lubrication system for lubricating moving components of the power transfer assembly, wherein the lubrication system is sealed from the first chamber and the second chamber to prevent the passage of fluid from the lubrication system into the first chamber and the second chamber, wherein the first chamber is a first combustion chamber operating a two-stroke cycle and the second chamber is a second combustion chamber operating a four-stroke cycle, and further comprising an external supercharger arranged to supply inlet air to the first combustion chamber.

16. An internal combustion engine comprising:

a piston mounted for reciprocating linear motion within a cylinder along a cylinder axis, the piston is coupled to an output shaft by a power transfer assembly arranged to convert linear motion of the piston to rotary motion of the output shaft, the piston has a first head at one end of the piston and moveable within a first chamber and a second head at an opposite end of the piston and moveable within a second chamber, the power transfer assembly has a lubrication system for lubricating moving components of the power transfer assembly, wherein the lubrication system is sealed from the first chamber and the second chamber to prevent the passage of fluid from the lubrication system into the first chamber and the second chamber, wherein the first chamber is a first combustion chamber operating a two-stroke cycle and the second chamber is a second combustion chamber operating a four-stroke cycle, and further comprising a turbocharger to supply inlet air to either the first combustion chamber or to both the first and second combustion chambers.

17. An internal combustion engine comprising:

a piston mounted for reciprocating linear motion within a cylinder along a cylinder axis, the piston is coupled to an output shaft by a power transfer assembly arranged to convert linear motion of the piston to rotary motion of the output shaft, the piston has a first head at one end of the piston and moveable within a first chamber and a second head at an opposite end of the piston and moveable within a second chamber, the power transfer assembly has a lubrication system for lubricating moving components of the power transfer assembly, wherein the lubrication system is sealed from the first chamber and the second chamber to prevent the passage of fluid from the lubrication system into the first chamber and the second chamber, a first oil seal between the piston and the cylinder on one side of the power transfer assembly, and a second oil seal between the piston and the cylinder on the other side of the power transfer assembly, wherein the first chamber is a first combustion chamber and the second chamber is a second combustion chamber, and further comprising an external supercharger arranged to supply inlet air to the first and second combustion chambers alternately, and wherein a first piston-to-bore clearance between the first head and the cylinder is greater than a second piston-to-bore clearance extending between a region adjacent the first oil seal to a region adjacent the second oil seal.

18. An internal combustion engine according to claim 17, wherein a third piston-to-bore clearance between the second head and the cylinder is greater than the second piston-to-bore clearance.

19. An internal combustion engine according to claim 4, including a plurality of pistons.

20. An internal combustion engine according to claim 19, wherein two or more of the pistons are mounted for reciprocating linear motion within a common cylinder.

21. An internal combustion engine according to claim 20, wherein an adjacent pair of the pistons are arranged in an opposed relationship and share a common combustion chamber.

22. An internal combustion engine according to claim 19, wherein each piston is coupled to a respective power transfer assembly.

23. An internal combustion engine according to claim 22, wherein the power transfer assemblies are arranged to operate the adjacent pair of pistons out of phase.

24. An internal combustion engine according to claim 22, wherein a plurality of the power transfer assemblies are coupled to a common output shaft.

25. An internal combustion engine according to claim 22, wherein each piston is coupled to a respective output shaft by a respective one of the power transfer assemblies.

26. An internal combustion engine according to claim 4, wherein the output shafts are arranged to drive one or more drive shafts in rotation, wherein the one or more drive shafts are rotatable about drive axes substantially parallel to the cylinder axis.

27. An internal combustion engine according to claim 26, wherein one drive shaft is arranged to be driven by multiple output shafts including the output shaft, and further comprising a mechanical coupling for synchronizing the rotational position of the multiple output shafts.

28. An internal combustion engine according to claim 4, which is a two cycle engine.

29. An internal combustion engine according to claim 4, which is powered by a gaseous phase fuel.

30. A propulsion unit for a water craft including the internal combustion engine comprising a piston mounted for reciprocating linear motion within a cylinder along a cylinder axis, the piston is coupled to an output shaft by a power transfer assembly arranged to convert linear motion of the piston to rotary motion of the output shaft, the piston has a first head at one end of the piston and moveable within a first chamber and a second head at an opposite end of the piston and moveable within a second chamber, the power transfer assembly has a lubrication system for lubricating moving components of the power transfer assembly, wherein the lubrication system is sealed from the first chamber and the second chamber to prevent the passage of fluid from the lubrication system into the first chamber and the second chamber, wherein multiple output shafts, including the output shaft, are arranged to drive one or more drive shafts in rotation, wherein the one or more drive shafts are rotatable about drive axes substantially parallel to the cylinder axis, wherein one drive shaft is arranged to be driven by the multiple output shafts, and wherein the internal combustion engine further comprises a mechanical coupling for synchronizing the rotational position of the multiple output shafts, and further comprising a steering post above the internal combustion engine and a hinged joint between the steering post and the one drive shaft.

31. A propulsion unit according to claim 30, further comprising one of a propeller and an impeller arranged to be driven in rotation by the engine.

32. A propulsion unit according to claim 31, wherein the cylinder axis is oriented substantially parallel to an axis of rotation of the propeller or impeller.

33. A propulsion unit according to claim 31, wherein the cylinder axis is oriented substantially perpendicularly to the axis of rotation of the propeller or impeller.

34. A propulsion unit according to claim 30, wherein the engine has an exhaust outlet submerged beneath a surface of a body of water in which the watercraft is operating.

35. A propulsion unit according to claim 30, wherein the steering post includes one or more of a breathing snorkel, a fuel supply line, a pull start cord, and engine control electronics.

36. A propulsion unit according to claim 31, further comprising shielding arranged between the hinged joint and the propeller or impeller.

37. A propulsion unit according to claim 30, wherein the internal combustion engine is adapted to operate at least partially submerged beneath a surface of a body of water in which the watercraft is operating.

38. A propulsion unit according to claim 37, wherein the internal combustion engine further comprises a casing arranged to provide direct cooling of the engine by the surrounding body of water.

39. A propulsion unit according to claim 37, wherein the internal combustion engine is coated in an insulating paint to regulate heat conveyed to the surrounding body of water.

40. A propulsion unit according to claim 37, wherein the internal combustion engine further comprises a cowling surrounding the casing to retain a locally warm portion of water.

41. An internal combustion engine according to claim 7, wherein the piston is mechanically coupled to the pump.

42. An internal combustion engine according to claim 7, wherein said piston is a first piston, and said pump comprises a second piston arranged for reciprocating motion within a second cylinder, and wherein the first piston is mechanically coupled to the second piston.

43. An internal combustion engine according to claim 7, wherein said piston is a first piston, said cylinder axis is a first cylinder axis, and said pump comprises a second piston arranged for reciprocating linear motion within a second cylinder along a second cylinder axis, wherein the second cylinder axis is parallel to the first cylinder axis.

* * * * *